US009494898B2

(12) United States Patent
Sasaki et al.

(10) Patent No.: US 9,494,898 B2
(45) Date of Patent: Nov. 15, 2016

(54) IMAGE FORMATION METHOD AND IMAGE FORMATION APPARATUS

(71) Applicant: Konica Minolta, Inc., Chiyoda-ku, Tokyo (JP)

(72) Inventors: Kunitomo Sasaki, Takatsuki (JP); Naoki Yoshie, Ibaraki (JP); Masahiro Anno, Sakai (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/636,258

(22) Filed: Mar. 3, 2015

(65) Prior Publication Data

US 2015/0253683 A1 Sep. 10, 2015

(30) Foreign Application Priority Data

Mar. 4, 2014 (JP) ..... 2014-041654

(51) Int. Cl.

| | |
|---|---|
| ***G03G 13/00*** | (2006.01) |
| ***G03G 15/20*** | (2006.01) |
| ***G03G 13/20*** | (2006.01) |
| ***G03G 13/22*** | (2006.01) |
| ***G03G 9/13*** | (2006.01) |
| ***G03G 9/087*** | (2006.01) |
| ***G03G 9/093*** | (2006.01) |

(52) U.S. Cl.

CPC ..... *G03G 15/2053* (2013.01); *G03G 9/08755* (2013.01); *G03G 9/08764* (2013.01); *G03G 9/08791* (2013.01); *G03G 9/08795* (2013.01); *G03G 9/08797* (2013.01); *G03G 9/09321* (2013.01); *G03G 9/09371* (2013.01); *G03G 9/13* (2013.01); *G03G 13/20* (2013.01); *G03G 13/22* (2013.01); *G03G 15/2064* (2013.01)

(58) Field of Classification Search

CPC ..... G03G 13/20; G03G 13/22; G03G 9/13
USPC ..... 430/124.1, 119.1
See application file for complete search history.

(56) References Cited

FOREIGN PATENT DOCUMENTS

| | | |
|---|---|---|
| JP | 2005-49488 A | 2/2005 |
| JP | 2009-96994 A | 5/2009 |

*Primary Examiner* — Mark A Chapman
(74) *Attorney, Agent, or Firm* — Buchanan Ingersoll & Rooney PC

(57) ABSTRACT

An image formation method includes a step of preparing an electrostatic latent image developer, a transferring step, and a fixation step. The step of preparing an electrostatic latent image developer includes a step of preparing an electrostatic latent image developer containing toner particles having prescribed viscoelasticity characteristics. The fixation step includes steps of heating a recording medium and fixing the toner particles to the recording medium at a pressure not lower than 200 kPa and not higher than 800 kPa.

14 Claims, 7 Drawing Sheets

IMAGE FORMATION METHOD AND IMAGE FORMATION APPARATUS

This application is based on Japanese Patent Application No. 2014-041654 filed with the Japan Patent Office on Mar. 4, 2014, the entire content of which is hereby incorporated by reference.

BACKGROUND OF THE INVENTION

1. Field of the Invention

The present invention relates to an image formation method and an image formation apparatus.

2. Description of the Related Art

Shrinkage or deformation of a recording medium due to heat during fixation has been a problem in use of electrophotography in production printing required to be high in paper registration accuracy. In other words, fixation at a low temperature has been required (Japanese Laid-Open Patent Publication No. 2005-049488) and fixation at 100° C. or lower has been desired, because a main cause of shrinkage or deformation of paper representing the recording media is moisture content in the recording media.

SUMMARY OF THE INVENTION

FIG. 1 shows a graph schematically showing temperature dependency of a storage elastic modulus. FIG. 2 shows a graph schematically showing temperature dependency of an amount of displacement when a constant pressure is applied to toner. In FIGS. 1 and 2, a graph A shows characteristics of toner mainly composed of an amorphous resin, and a graph B shows characteristics of toner having excellent fixability at a low temperature and exhibiting stable fixation quality in a wide temperature range. An "amount of displacement" in FIG. 2 is calculated by dividing force applied to toner by a storage elastic modulus.

Toner mainly composed of an amorphous resin has such characteristics that, at a temperature higher than a softening temperature, a storage elastic modulus gently lowers with increase in temperature. Therefore, when expression of fixability at a low temperature by this toner is attempted, storage stability is lowered.

In addition, owing to the characteristics above, toner mainly composed of an amorphous resin is affected by temperature variation in a recording medium during fixation. "Temperature variation in a recording medium during fixation" includes temperature variation in a recording medium between timing of start of printing and timing of successive paper feed or in-plane temperature variation of a recording medium. Variation in fixation quality is caused by such temperature variation. For example, offset due to too high a temperature or uneven gloss due to temperature variation is caused. From the foregoing, toner having excellent fixability at a low temperature and exhibiting stable fixation quality in a wide temperature range has been demanded.

In order to meet the demand, toner desirably has such characteristics that a storage elastic modulus abruptly lowers at a prescribed temperature. This storage elastic modulus of toner, however, has a second point of inflection at a temperature higher than the prescribed temperature and it hardly lowers at a temperature higher than the second point of inflection. Specifically, as shown in FIG. 2, an amount of displacement of toner mainly composed of an amorphous resin significantly varies in a fixation temperature region (70° C. to 100° C.) (graph A), while an amount of displacement of toner meeting the demand hardly changes in the fixation temperature region (graph B). Therefore, even though a temperature is increased during fixation, toner meeting the demand is less likely to deform. Here, in order for toner to be fixed to a recording medium and to have a certain degree of gloss, the toner should deform by a certain amount or more during fixation. Therefore, it has been found that, when the toner meeting the demand is used to form an image, an image not having excellent glossiness may be obtained.

The present invention was made in view of such aspects, and an object of the present invention is to provide an image formation method for obtaining an image which can be fixed at a low temperature and have stable fixation quality in a wide temperature range and excellent glossiness. Another object of the present invention is to provide an image formation apparatus with which such an image formation method can be performed.

An image formation method according to the present invention includes the steps of preparing an electrostatic latent image developer having toner particles containing a coloring agent and a resin and satisfying A to C below, transferring the electrostatic latent image developer to a recording medium, and fixing the toner particles contained in the electrostatic latent image developer transferred to the recording medium to the recording medium. The step of fixing the toner particles to the recording medium includes the steps of heating the recording medium and fixing the toner particles to the recording medium at a pressure P not lower than 200 kPa and not higher than 800 kPa.

$$A:\ G'(T_0)/G'(T_0+10) \geq 10 \qquad \text{Expression(1)}$$

$$40 \leq T_0 \leq 60 \qquad \text{Expression (2)}$$

are satisfied, where $G'(T_0)$ represents a storage elastic modulus (mPa·s) of the toner particles at $T_0$ (° C.) and $G'(T_0+10)$ represents a storage elastic modulus (mPa·s) of the toner particles at $(T_0+10)$ (° C.).

B: A storage elastic modulus of the toner particles at 70° C. G'(70° C.) is not lower than $3\times10^5$ mPa·s and not higher than $3\times10^7$ mPa·s.

C: A storage elastic modulus of the toner particles does not have a relative minimum value and a relative maximum value at a temperature not lower than 70° C. and not higher than 100° C. and $$G'(70°\ C.)/G'(100°\ C.) \leq 10 \qquad \text{Expression(3)}$$

is satisfied, where G'(70° C.) represents a storage elastic modulus of the toner particles at 70° C. and G'(100° C.) represents a storage elastic modulus of the toner particles at 100° C.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
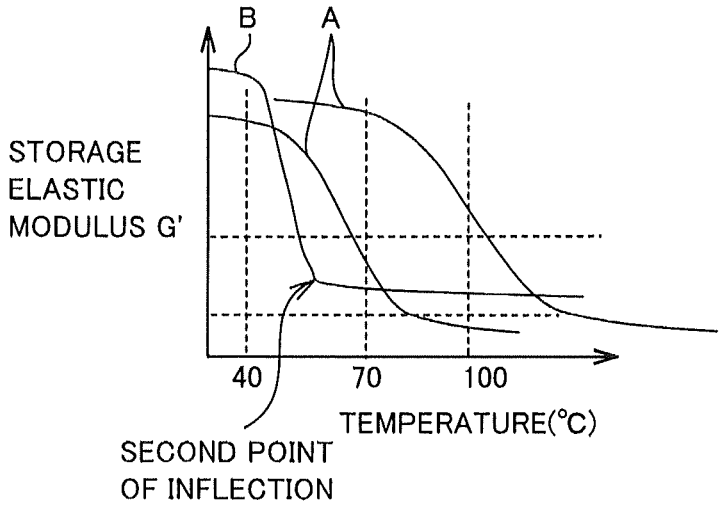
FIG. 1 is a graph schematically showing temperature dependency of a storage elastic modulus.
Figure 2:
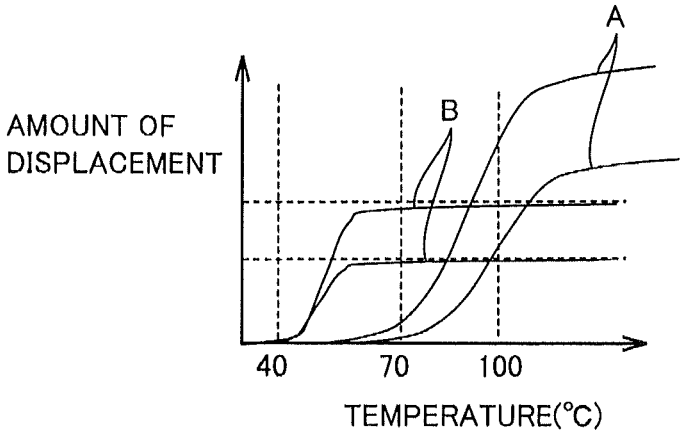
FIG. 2 is a graph schematically showing temperature dependency of an amount of displacement when a constant pressure is applied to toner.

An image formation method and an image formation apparatus according to the present invention will be described below with reference to the drawings. In the drawings of the present invention, the same or corresponding elements have the same reference characters allotted. Relation of such a dimension as a length, a width, a thickness, or a depth is modified as appropriate for clarity and brevity of the drawings and does not represent actual dimensional relation.

[Image Formation Method]

An image formation method according to the present invention includes a step of preparing an electrostatic latent image developer, a transferring step, and a fixation step.

<Preparation of Electrostatic Latent Image Developer>

A developer for an electrostatic latent image will be described and then a method of manufacturing the same will be described.

<Electrostatic Latent Image Developer>

A developer for an electrostatic latent image is useful, for example, as a liquid developer for electrophotography used in an image formation apparatus of an electrophotography type such as a copying machine, a printer, a digital printer, or a simple printer, a paint, a liquid developer for electrostatic recording, an oil-based ink for ink jet printer, or an ink for electronic paper. The developer for an electrostatic latent image generally includes a liquid developer and a dry developer.

The liquid developer contains toner particles and an insulating liquid. The liquid developer preferably contains 10 to 50 mass % of toner particles and 50 to 90 mass % of the insulating liquid. The liquid developer may contain any component (for example, a charge control agent, a thickener, or a dispersant) other than the toner particles and the insulating liquid.

The dry developer includes a one-component developer and a two-component developer. The one-component developer is made of toner particles. The two-component developer contains toner particles and a carrier.

<Toner Particles>

Toner particles contained in a liquid developer and toner particles contained in a dry developer each contain a resin and a coloring agent. A content of each of the resin and the coloring agent in the toner particles is preferably determined such that desired image density is obtained when an amount of adhesion of toner particles to a recording medium is within a prescribed range. In the toner particles contained in the liquid developer, from a point of view of fixability of the toner particles and coloring capability of the toner in the liquid developer (image density with respect to an amount of adhesion of the toner), a content of the toner particles in the liquid developer is preferably from 10 to 50 mass %, more preferably from 15 to 45 mass %, and further preferably from 20 to 40 mass %.

The toner particles satisfy A to C below.

$$A:\ G'(T_0)/G'(T_0+10) \geq 10 \qquad \text{Expression(1)}$$

$$40 \leq T_0 \leq 60 \qquad \text{Expression (2)}$$

are satisfied, where $G'(T_0)$ represents a storage elastic modulus (mPa·s) of the toner particles at $T_0$ (° C.) and $G'(T_0+10)$ represents a storage elastic modulus (mPa·s) of the toner particles at $(T_0+10)$ (° C.).

B: A storage elastic modulus of the toner particles at 70° C. G'(70° C.) is not lower than $3\times10^5$ mPa·s and not higher than $3\times10^7$ mPa·s.

C: A storage elastic modulus of the toner particles does not have a relative minimum value and a relative maximum value at a temperature not lower than 70° C. and not higher than 100° C. and $$G'(70°\ C.)/G'(100°\ C.) \leq 10 \qquad \text{Expression(3)}$$

is satisfied, where G'(100° C.) represents a storage elastic modulus of the toner particles at 100° C.

As the toner particles satisfy A above, a storage elastic modulus of the toner particles abruptly lowers at a specific temperature. Thus, fixability at a low temperature and storage stability can both be achieved. Specifically, when $T_0$ satisfying the Expression (1) is not lower than 40° C., high storage stability of the toner particles can be maintained. When $T_0$ satisfying the Expression (1) is not higher than 60° C., occurrence of cold offset (removal of a part of a toner image formed on a recording medium due to adhesive force or electrostatic attraction force between a fixation roller and the toner particles at the time when the toner particles are fixed with the use of a heat roller) can be prevented and hence an image excellent in fixation quality is obtained. In addition, an image excellent in glossiness is obtained. Preferably, a condition of $G'(T_0)/G'(T_0+10) \geq 50$ is satisfied. Since it is difficult to realize a condition of $G'(T_0)/G'(T_0+10) > 300$, a condition of $G'(T_0)/G'(T_0+10) \leq 300$ is preferably satisfied.

As the toner particles satisfy B above, the toner particles deform during fixation when a pressure during fixation is not lower than 200 kPa and not higher than 800 kPa. Therefore, an image excellent in glossiness can be obtained. Specifically, when a storage elastic modulus of the toner particles at 70° C. G'(70° C.) is not lower than $3\times10^5$ mPa·s, occurrence of high-temperature offset can be prevented. When a storage elastic modulus of the toner particles at 70° C. G'(70° C.) is not higher than $3\times10^7$ mPa·s, a desired degree of gloss can be obtained.

As the toner particles satisfy C above, a storage elastic modulus of the toner particles has substantially no temperature dependency at a temperature not lower than 70° C. and not higher than 100° C. Thus, suppression of occurrence of high-temperature offset in a wide temperature range and formation of an image excellent in glossiness can both be achieved.

A storage elastic modulus herein was measured with the use of a viscoelasticity measurement apparatus manufactured by TA Instruments, Japan, with a method of measuring viscoelasticity of a sample with a measurement start temperature being set to 40° C., a temperature increase rate being set to 3° C./min., and a frequency being set to 1 Hz. In measurement of a storage elastic modulus of toner particles contained in a liquid developer, a liquid is removed from the liquid developer to thereby obtain a powdery state and then a storage elastic modulus of the obtained powders is measured. In measurement of a storage elastic modulus of toner particles contained in a dry developer, a storage elastic modulus of a dry developer is measured, which is also applicable to Examples which will be described later.

<Resin>

Toner particles contained in a liquid developer preferably contain a first resin and more preferably contain a first resin and a second resin.

<Urethane-Modified Polyester Resin: First Resin>

The resin preferably satisfies D to G below.

D: The resin contains 80 mass % or more of a first resin which is a urethane-modified polyester resin resulting from increase in chain length of a component derived from a polyester resin by a compound containing an isocyanate group.

The "component derived from the polyester resin" means a polyester resin from which one or more atoms have been removed from terminal end(s), and it includes a polyester resin from which one hydrogen atom has been removed from each of opposing terminal ends and a polyester resin from which one hydrogen atom has been removed from one terminal end.

A "chain length" means bonding between a component derived from a polyester resin and a compound containing an isocyanate group such that the urethane-modified polyester resin is linear.

E: The component derived from the polyester resin contains a constitutional unit derived from an acid component and a constitutional unit derived from an alcohol component.

F: A ratio of a constitutional unit derived from an aliphatic monomer occupied in the constitutional unit derived from the acid component and the constitutional unit derived from the alcohol component is not lower than 80 mass %.

G: A concentration of a urethane group in the urethane-modified polyester resin is not lower than 0.5% and not higher than 5%.

A "concentration of a urethane group" is a value found by calculating (a mass of a urethane group in a urethane-modified polyester resin)÷(a mass of the urethane-modified polyester resin)×100.

As the resin satisfies D above, crystallinity of the resin is enhanced. Therefore, when the resin satisfies D above, the toner particles will satisfy A to C above.

The urethane-modified polyester resin is a resin having such a structure that a terminal of a polyester resin has been increased in length by urethane bond. Namely, the urethane-modified polyester resin is a resin in which at least two polyesters are bonded to a compound containing an isocyanate group. The urethane-modified polyester resin preferably exhibits crystallinity (which will be described later).

A urethane-modified polyester resin is obtained, for example, by polymerizing polyol (an alcohol component) with polycarboxylic acid (an acid component), acid anhydride of polycarboxylic acid (an acid component), or ester of lower alkyl of polycarboxylic acid (an acid component) to thereby obtain a polycondensed product (a polyester resin) and then increasing a chain length of the polyester resin with di(tri)isocyanate. A known polycondensation catalyst can be used for polymerization reaction. A ratio between polyol and polycarboxylic acid is not particularly limited. A ratio between polyol and polycarboxylic acid should only be set such that an equivalent ratio between a hydroxyl group [OH] and a carboxyl group [COOH]([OH]/[COOH]) is set preferably to 2/1 to 1/5, more preferably to 1.5/1 to 1/4, and further preferably to 1.3/1 to 1/3.

The resin more preferably contains 90 mass % or more of the urethane-modified polyester resin and further preferably it consists of the urethane-modified polyester resin. A content of the urethane-modified polyester resin may be calculated, for example, from a spectrum obtained from measurement of an infrared absorption spectrum, from a spectrum obtained in nuclear magnetic resonance, or with a gas chromatograph mass spectrometer (GCMS). The resin may contain 20 mass % or less of a resin different from the urethane-modified polyester resin (a second resin) (which will be described later).

As the resin satisfies F above, a component derived from the polyester resin is linear, and hence the urethane-modified polyester resin (the first resin) is linear. Therefore, when the resin satisfies F above, the toner particles will satisfy A to C above.

An aliphatic monomer includes an aliphatic monomer derived from an acid component and an aliphatic monomer derived from an alcohol component. The aliphatic monomer derived from the acid component preferably has a straight chain alkyl skeleton having a carbon number not smaller than 4, and it is more preferably aliphatic dicarboxylic acid. Preferably, aliphatic dicarboxylic acid is, for example, alkane dicarboxylic acid having a carbon number from 4 to 20, alkene dicarboxylic acid having a carbon number from 4 to 36, or an ester-forming derivative thereof. More preferably, aliphatic dicarboxylic acid is succinic acid, adipic acid, sebacic acid, maleic acid, fumaric acid, or an ester-forming derivative thereof.

The aliphatic monomer derived from the alcohol component preferably has a straight chain alkyl skeleton having a carbon number not smaller than 4, and it is more preferably aliphatic diol. Aliphatic diol is preferably, for example, ethylene glycol, 1,3-propylene glycol, 1,4-butanediol, 1,6-hexanediol, 1,9-nonanediol, or 1,10-decanediol.

A compound containing an isocyanate group is preferably a compound having a plurality of isocyanate groups in a molecule, and it is preferably, for example, chain aliphatic polyisocyanate or cyclic aliphatic polyisocyanate.

Chain aliphatic polyisocyanate is preferably, for example, ethylene diisocyanate, tetramethylene diisocyanate, hexamethylene diisocyanate (hereinafter abbreviated as "HDI"), dodecamethylene diisocyanate, 1,6,11-undecane triisocyanate, 2,2,4-trimethyl hexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-diisocyanatohexanoate, or two or more of these as being used together.

Cyclic aliphatic polyisocyanate is preferably, for example, isophoron diisocyanate (hereinafter abbreviated as "IPDI"), dicyclohexylmethane-4,4'-diisocyanate (hereinafter also denoted as "hydrogenated MDI"), cyclohexylene diisocyanate, methylcyclohexylene diisocyanate (hereinafter also denoted as "hydrogenated TDI"), bis(2-isocyanatoethyl)-4-cyclohexene-1,2-dicarboxylate, 2,5-norbornane diisocyanate, and 2,6-norbornane diisocyanate, or two or more of these as being used together.

A ratio of a constitutional unit derived from an aliphatic monomer occupied in a constitutional unit derived from an acid component and a constitutional unit derived from an alcohol component is more preferably not lower than 90 mass % and further preferably not lower than 95 mass %. This ratio may be found from a spectrum obtained in nuclear magnetic resonance or with GCMS. If the first resin expresses crystallinity, the first resin may contain a constitutional unit derived from an aromatic monomer. For example, a ratio of a constitutional unit derived from an aromatic monomer occupied in a constitutional unit derived from an acid component and a constitutional unit derived from an alcohol component may be not higher than 10 mass %.

As the resin satisfies G above, elasticity of the toner particles in a high-temperature region can be maintained at desired elasticity. Therefore, the toner particles can satisfy B above. In addition, when a concentration of a urethane group in the urethane-modified polyester resin is not higher than 5%, occurrence of document offset can be prevented. A concentration of a urethane group in the urethane-modified polyester resin is more preferably not lower than 0.8% and not higher than 5% and further preferably not lower than 1% and not higher than 3%.

By adjusting an equivalent ratio between an amount of an acid group and an amount of a hydroxyl group ([an acid group]/[a hydroxyl group]) which are source materials of the polyester resin or an equivalent ratio between an amount of an isocyanate group and an amount of a hydroxyl group ([an isocyanate group]/[a hydroxyl group]), a concentration of a urethane group in the urethane-modified polyester resin can be controlled within a prescribed range.

A concentration of a urethane group is measured with a method shown below. Initially, a urethane-modified polyester resin is thermally decomposed under conditions shown below. Then, a concentration of the urethane group in the urethane-modified polyester resin thermally decomposed under the conditions shown below is measured with GCMS.

(Conditions for Thermal Decomposition)

Apparatus: PY-2020iD manufactured by Frontier Laboratories Ltd.

Mass of Sample: 0.1 mg

Heating Temperature: 550° C.

Heating Time Period: 0.5 minute (Conditions for Measurement of Concentration of Urethane Group)

Apparatus: QP2010 manufactured by Shimadzu Corporation

Column: UltraALLOY-5 manufactured by Frontier Laboratories Ltd. (inner diameter: 0.25 mm, length: 30 m, thickness: 0.25 μm)

Temperature Increase Condition: Temperature Increase Range: 100° C. to 320° C. (held at 320° C.), Rate of Temperature Increase: 20° C./min.

(Number Average Molecular Weight Mn)

A urethane-modified polyester resin preferably has a number average molecular weight Mn not smaller than 10000 and not greater than 50000. When Mn is not smaller than 10000, the resin is prevented from becoming excessively soft during fixation and hence occurrence of high-temperature offset can be prevented. When Mn is not greater than 50000, difficulty in melt of the resin during fixation is prevented and hence high fixation strength can be maintained. More preferably, Mn is not smaller than 10000 and not greater than 30000.

Mn of the urethane-modified polyester resin can be controlled within a prescribed range by adjusting an equivalent ratio between an amount of an acid group and an amount of a hydroxyl group ([an acid group]/[a hydroxyl group]) which are source materials of the polyester resin or an equivalent ratio between an amount of an isocyanate group and an amount of a hydroxyl group ([an isocyanate group]/[a hydroxyl group]).

Number average molecular weight Mn of the urethane-modified polyester resin can be measured with gel permeation chromatography (GPC) under conditions below, with respect to solubles in tetrahydrofuran (THF). Mn of a resin other than a polyurethane resin can also be measured under conditions shown below.

Measurement apparatus: "HLC-8120" manufactured by Tosoh Corporation

Column: "TSKgel GMHXL" (two) manufactured by Tosoh Corporation and "TSKgel Multipore HXL-M" (one) manufactured by Tosoh Corporation Sample solution: 0.25 mass % of THF solution Amount of injection of sample solution into column: 100

Flow rate: 1 ml/min.

Measurement temperature: 40° C.

Detection apparatus: Refraction index detector

Reference material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

Mn of a polyurethane resin can be measured with the use of GPC under conditions below.

Measurement apparatus: "HLC-8220GPC" manufactured by Tosoh Corporation

Column: "Guardcolumn α" (one) and "TSKgel α-M" (one)

Sample solution: 0.125 mass % of dimethylformamide solution

Amount of injection of dimethylformamide solution into column: 100

Flow rate: 1 ml/min.

Measurement temperature: 40° C.

Detection apparatus: Refraction index detector

Reference material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

(Crystallinity)

"Crystallinity" means that a ratio between a softening start temperature of a resin (hereinafter abbreviated as "Tm") and a maximum peak temperature (hereinafter abbreviated as "Ta") of heat of fusion of the resin (Tm/Ta) is not lower than 0.8 and not higher than 1.55 and that a result of change in amount of heat obtained in differential scanning calorimetry (abbreviated as DSC) does not show stepwise change in amount of heat absorption but has a clear heat absorption peak. A ratio between Tm and Ta (Tm/Ta) being higher than 1.55 can mean that such a resin is not excellent in crystallinity and also that such a resin has non-crystallinity.

A flow tester (capillary rheometer) (such as CFT-500D manufactured by Shimadzu Corporation) can be used to measure Tm. Specifically, while 1 g of a sample is heated at a temperature increase rate of 6° C./min., a plunger applies load of 1.96 MPa to the sample to thereby extrude the sample from a nozzle having a diameter of 1 mm and a length of 1 mm. Relation between "an amount of lowering of the plunger (a value of flow)" and a "temperature" is plotted in a graph. A temperature at the time when an amount of lowering of the plunger is ½ of a maximum value of the amount of lowering is read from the graph, and this value (a temperature at which half of the measurement sample was extruded from the nozzle) is adopted as Tm.

A differential scanning calorimeter (for example, "DSC210" manufactured by Seiko Instruments, Inc.) can be used to measure Ta. Specifically, a sample is molten at 130° C., thereafter a temperature is lowered from 130° C. to 70° C. at a rate of 1.0° C./min., and thereafter a temperature is lowered from 70° C. to 10° C. at a rate of 0.5° C./min.

Thereafter, with the DSC method, a temperature of the sample is raised at a temperature increase rate of 20° C./min., change in heat absorption and generation of the sample is measured, and relation between an "amount of heat absorption and generation" and a "temperature" is plotted in a graph. Here, a temperature of a heat absorption peak observed in a range from 20 to 100° C. is defined as Ta'. When there are a plurality of heat absorption peaks, a temperature of a peak largest in amount of heat absorption is defined as Ta'. After the sample was stored for 6 hours at (Ta'−10)° C., it is in turn stored for 6 hours at (Ta'−15)° C.

After pre-treatment of the sample ends, with the DSC method, the sample subjected to the pre-treatment above is cooled to 0° C. at a temperature lowering rate of 10° C./min., and then a temperature is raised at a temperature increase rate of 20° C./min. Based on change in heat absorption and generation thus measured, relation between an "amount of heat absorption and generation" and a "temperature" is plotted in a graph. A temperature at which an amount of heat absorption attains to a maximum value is defined as a maximum peak temperature (Ta) of heat of fusion.

<Second Resin>

The second resin is preferably, for example, a vinyl resin, a polyester resin, a polyurethane resin, an epoxy resin, a polyamide resin, a polyimide resin, a silicon resin, a phenol resin, a melamine resin, a urea resin, an aniline resin, an ionomer resin, or a polycarbonate resin, or may be two or more types thereof as being mixed. The second resin is more preferably at least one of a vinyl resin, a polyester resin, a polyurethane resin, and an epoxy resin, and further preferably at least one of a polyester resin and a polyurethane resin. Then, toner particles have a spherical shape.

(Vinyl Resin)

The vinyl resin may be a homopolymer obtained by homopolymerizing a monomer having polymeric double bond or a copolymer obtained by copolymerizing two or more types of monomers having polymeric double bond. A monomer having polymeric double bond is preferably, for example, (1) to (9) below.

(1) Hydrocarbon Having Polymeric Double Bond

Hydrocarbon having polymeric double bond is preferably, for example, aliphatic hydrocarbon having polymeric double bond shown in (1-1) below or aromatic hydrocarbon having polymeric double bond shown in (1-2) below.

(1-1) Aliphatic Hydrocarbon Having Polymeric Double Bond

Aliphatic hydrocarbon having polymeric double bond is preferably, for example, chain hydrocarbon having polymeric double bond shown in (1-1-1) below or cyclic hydrocarbon having polymeric double bond shown in (1-1-2) below.

(1-1-1) Chain Hydrocarbon Having Polymeric Double Bond

Chain hydrocarbon having polymeric double bond is preferably, for example, alkene having a carbon number from 2 to 30 (such as ethylene, propylene, butene, isobutylene, pentene, heptene, diisobutylene, octene, dodecene, or octadecene) or alkadiene having a carbon number from 4 to 30 (such as butadiene, isoprene, 1,4-pentadiene, 1,5-hexadiene, or 1,7-octadiene).

(1-1-2) Cyclic Hydrocarbon Having Polymeric Double Bond

Cyclic hydrocarbon having polymeric double bond is preferably, for example, mono- or di-cycloalkene having a carbon number from 6 to 30 (such as cyclohexene, vinyl cyclohexane, or ethylidene bicycloheptane) or mono- or di-cycloalkadiene having a carbon number from 5 to 30 (such as cyclopentadiene or dicyclopentadiene).

(1-2) Aromatic Hydrocarbon Having Polymeric Double Bond

Aromatic hydrocarbon having polymeric double bond is preferably, for example, styrene, vinyl naphthalene, or hydrocarbyl (such as alkyl, cycloalkyl, aralkyl, and/or alkenyl having a carbon number from 1 to 30) substitute of styrene (such as α-methylstyrene, vinyl toluene, 2,4-dimethylstyrene, ethylstyrene, isopropylstyrene, butylstyrene, phenylstyrene, cyclohexylstyrene, benzylstyrene, crotylbenzene, divinyl benzene, divinyl toluene, divinyl xylene, or trivinyl benzene).

(2) Monomer Having Carboxyl Group and Polymeric Double Bond and Salt Thereof

A monomer having a carboxyl group and polymeric double bond is preferably, for example, unsaturated monocarboxylic acid having a carbon number from 3 to 15 [such as (meth)acrylic acid, crotonic acid, isocrotonic acid, or cinnamic acid], unsaturated dicarboxylic acid (unsaturated dicarboxylic anhydride) having a carbon number from 3 to 30 [such as maleic acid (maleic anhydride), fumaric acid, itaconic acid, citraconic acid (citraconic anhydride), or mesaconic acid], or monoalkyl (having a carbon number from 1 to 10) ester of unsaturated dicarboxylic acid having a carbon number from 3 to 10 (such as maleic acid monomethyl ester, maleic acid monodecyl ester, fumaric acid monoethyl ester, itaconic acid monobutyl ester, or citraconic acid monodecyl ester). "(Meth)acrylic acid" herein means acrylic acid and/or methacrylic acid.

The salt of the monomer above is preferably, for example, alkali metal salt (such as sodium salt or potassium salt), alkaline earth metal salt (such as calcium salt or magnesium salt), ammonium salt, amine salt, or quaternary ammonium salt.

Amine salt is not particularly limited so long as it is an amine compound and is preferably, for example, primary amine salt (such as ethylamine salt, butylamine salt, or octylamine salt), secondary amine salt (such as diethylamine salt or dibutylamine salt), or tertiary amine salt (such as triethylamine salt or tributylamine salt).

Quaternary ammonium salt is preferably, for example, tetraethyl ammonium salt, triethyl lauryl ammonium salt, tetrabutyl ammonium salt, or tributyl lauryl ammonium salt.

Salt of the monomer having a carboxyl group and polymeric double bond is preferably, for example, sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, or aluminum acrylate.

(3) Monomer Having Sulfo Group and Polymeric Double Bond and Salt Thereof

A monomer having a sulfo group and polymeric double bond is preferably, for example, vinyl sulfonic acid, α-methylstyrene sulfonic acid, sulfopropyl(meth)acrylate, or 2-(meth)acryloylamino-2,2-dimethylethane sulfonic acid. Salt of a monomer having a sulfo group and polymeric double bond is preferably, for example, salts listed as the "salt of the monomer above" in "(2) Monomer Having Carboxyl Group and Polymeric Double Bond" above.

(4) Monomer Having Phosphono Group and Polymeric Double Bond and Salt Thereof

A monomer having a phosphono group and polymeric double bond is preferably, for example, 2-hydroxyethyl (meth)acryloyl phosphate or 2-acryloyloxy ethyl phosphonic acid. Salt of the monomer having a phosphono group and polymeric double bond is preferably, for example, salts listed as the "salt of the monomer above" in "(2) Monomer Having Carboxyl Group and Polymeric Double Bond" above.

(5) Monomer Having Hydroxyl Group and Polymeric Double Bond

A monomer having a hydroxyl group and polymeric double bond is preferably, for example, hydroxystyrene, N-methylol(meth)acrylamide, or hydroxyethyl(meth)acrylate.

(6) Nitrogen-Containing Monomer Having Polymeric Double Bond

A nitrogen-containing monomer having polymeric double bond is preferably, for example, a monomer shown in (6-1) to (6-4) below.

(6-1) Monomer Having Amino Group and Polymeric Double Bond

A monomer having an amino group and polymeric double bond is preferably, for example, aminoethyl(meth)acrylate, dimethylaminoethyl(meth)acrylate, diethylaminoethyl (meth)acrylate, t-butylaminoethyl(meth)acrylate, N-aminoethyl(meth)acrylamide, (meth)allyl amine, morpholinoethyl (meth)acrylate, 4-vinylpyridine, 2-vinylpyridine, crotyl amine, N,N-dimethylamino styrene, methyl-α-acetamino acrylate, vinylimidazole, N-vinylpyrrole, N-vinyl thiopyrrolidone, N-aryl phenylenediamine, aminocarbazole, aminothiazole, aminoindole, aminopyrrole, aminoimidazole, or aminomercaptothiazole.

(6-2) Monomer Having Amide Group and Polymeric Double Bond

A monomer having an amide group and polymeric double bond is preferably, for example, (meth)acrylamide, N-methyl(meth)acrylamide, N-butyl(meth)acrylamide, diacetone acrylamide, N-methylol(meth)acrylamide, N,N'-methylene-bis(meth)acrylamide, cinnamic acid amide, N,N-dimethyl(meth)acrylamide, N,N-dibenzyl(meth)acrylamide, (meth)acrylformamide, N-methyl-N-vinylacetamide, or N-vinylpyrrolidone.

(6-3) Monomer Having Carbon Number from 3 to 10 and Having Nitrile Group and Polymeric Double Bond A monomer having a carbon number from 3 to 10 and having a nitrile group and polymeric double bond is preferably, for example, (meth)acrylonitrile, cyanostyrene, or cyanoacrylate.

(6-4) Monomer Having Carbon Number from 8 to 12 and Having Nitro Group and Polymeric Double Bond A monomer having a carbon number from 8 to 12 and having a nitro group and polymeric double bond is preferably, for example, nitrostyrene.

(7) Monomer Having Carbon Number from 6 to 18 and Having Epoxy Group and Polymeric Double Bond A monomer having a carbon number from 6 to 18 and having an epoxy group and polymeric double bond is preferably, for example, glycidyl(meth)acrylate.

(8) Monomer Having Carbon Number from 2 to 16 and Having Halogen Element and Polymeric Double Bond A monomer having a carbon number from 2 to 16 and having a halogen element and polymeric double bond is preferably, for example, vinyl chloride, vinyl bromide, vinylidene chloride, allyl chloride, chlorostyrene, bromostyrene, dichlorostyrene, chloromethylstyrene, tetrafluorostyrene, or chloroprene.

(9) Ester Having Carbon Number From 4 to 16 and Having Polymeric Double Bond

An ester having a carbon number from 4 to 16 and having polymeric double bond is preferably, for example, vinyl acetate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl(meth)acrylate, vinyl methoxy acetate, vinyl benzoate, ethyl-α-ethoxy acrylate, alkyl(meth)acrylate having an alkyl group having a carbon number from 1 to 11 [such as methyl(meth)acrylate, ethyl(meth)acrylate, propyl (meth)acrylate, butyl(meth)acrylate, or 2-ethylhexyl(meth) acrylate], dialkyl fumarate (two alkyl groups being straight-chain alkyl groups, branched alkyl groups, or alicyclic alkyl groups, having a carbon number from 2 to 8), dialkyl maleate (two alkyl groups being straight-chain alkyl groups, branched alkyl groups, or alicyclic alkyl groups, having a carbon number from 2 to 8), poly(meth)allyloxy alkanes (such as diallyloxyethane, triallyloxyethane, tetraallyloxyethane, tetraallyloxypropane, tetraallyloxybutane, or tetramethallyloxyethane), a monomer having a polyalkylene glycol chain and polymeric double bond [such as polyethylene glycol (Mn=300) mono(meth)acrylate, polypropylene glycol (Mn=500) mono(meth)acrylate, a 10-mole adduct(meth) acrylate of EO to methyl alcohol, or a 30-mole adduct(meth) acrylate of EO to lauryl alcohol], or poly(meth)acrylates {such as poly(meth)acrylate of polyhydric alcohols [such as ethylene glycol di(meth)acrylate, propylene glycol di(meth) acrylate, neopentyl glycol di(meth)acrylate, trimethylol propane tri(meth)acrylate, or polyethylene glycol di(meth)acrylate]}. "(Meth)allylo" herein means allylo and/or methallylo.

A specific example of a vinyl resin is preferably, for example, a styrene-(meth)acrylic acid ester copolymer, a styrene-butadiene copolymer, a (meth)acrylic acid-(meth) acrylic acid ester copolymer, a styrene-acrylonitrile copolymer, a styrene-maleic acid (maleic anhydride) copolymer, a styrene-(meth)acrylic acid copolymer, a styrene-(meth) acrylic acid-divinylbenzene copolymer, or a styrene-styrene sulfonic acid-(meth)acrylic acid ester copolymer.

The vinyl resin may be a homopolymer or a copolymer of a monomer having polymeric double bond in (1) to (9) above, or it may be a polymerized product of a monomer having polymeric double bond in (1) to (9) above and a monomer having polymeric double bond having a first molecular chain. The first molecular chain is preferably a straight-chain or branched hydrocarbon chain having a carbon number from 12 to 27, a fluoro-alkyl chain having a carbon number from 4 to 20, or a polydimethylsiloxane chain. A difference in SP value between the first molecular chain in the monomer having polymeric double bond having the first molecular chain and the insulating liquid in the liquid developer is preferably 2 or smaller. The "SP value" herein is a numeric value calculated with a Fedors' method [Polym. Eng. Sci. 14(2) 152, (1974)].

The monomer having polymeric double bond having the first molecular chain is preferably a monomer (m1) or a monomer (m2) below, or may be a mixture thereof. The monomer having polymeric double bond having the first molecular chain may be a monomer having a fluoro-alkyl chain having a carbon number from 4 to 20 and polymeric double bond.

The monomer (m1) having straight-chain hydrocarbon chain having a carbon number from 12 to 27 (preferably from 16 to 25) and polymeric double bond is preferably, for example, mono-straight-chain alkyl (a carbon number of alkyl being from 12 to 27) ester of unsaturated monocarboxylic acid or mono-straight-chain alkyl (a carbon number of alkyl being from 12 to 27) ester of unsaturated dicarboxylic acid. Unsaturated monocarboxylic acid and unsaturated dicarboxylic acid above are preferably, for example, a carboxyl group containing vinyl monomer having a carbon number from 3 to 24 such as (meth)acrylic acid, maleic acid, fumaric acid, crotonic acid, itaconic acid, or citraconic acid. A specific example of the monomer (m1) is preferably, for example, dodecyl(meth)acrylate, stearyl(meth)acrylate, behenyl(meth)acrylate, hexadecyl(meth)acrylate, heptadecyl(meth)acrylate, or eicosyl(meth)acrylate.

The monomer (m2) having branched hydrocarbon chain having a carbon number from 12 to 27 (preferably from 16 to 25) and polymeric double bond is preferably, for example, branched alkyl (a carbon number of alkyl being from 12 to 27) ester of unsaturated monocarboxylic acid or monobranched alkyl (a carbon number of alkyl being from 12 to 27) ester of unsaturated dicarboxylic acid. Unsaturated monocarboxylic acid and unsaturated dicarboxylic acid are preferably, for example, the same as those listed as specific examples of unsaturated monocarboxylic acid or unsaturated dicarboxylic acid with regard to the monomer (m1). A specific example of the monomer (m2) is preferably, for example, 2-decyltetradecyl(meth)acrylate.

The second resin preferably contains a vinyl resin having a hydrocarbon long chain provided in a molecule. Thus, the second resin has a functional group (a hydrocarbon long chain) high in affinity with an insulating liquid. Therefore, since the toner particles are readily dispersed in the insulating liquid, variation in mobility of toner particles can be kept low. This effect is noticeable when the toner particles have a core/shell structure (which will be described later) and more noticeable when a hydrocarbon long chain is included in a side chain of the vinyl resin.

The "hydrocarbon long chain" is a hydrocarbon group having a carbon number from 8 to 30. The hydrocarbon group may be a straight-chain hydrocarbon group, a branched hydrocarbon group, or a group cyclized in part or in its entirety. The hydrocarbon group may include double bond or triple bond. The hydrocarbon group may be a group in which some hydrogen atoms are substituted with atoms different from hydrogen atoms or an atomic group. When a specific example of the vinyl resin contains a hydrocarbon group having a carbon number from 8 to 30, that component is the hydrocarbon long chain.

(Melting Point, Mn, and SP Value)

The second resin has a melting point preferably from 0 to 220° C., more preferably from 30 to 200° C., and further preferably from 40 to 80° C. The melting point of the second resin is measured with a differential scanning calorimeter ("DSC20" or "SSC/580" manufactured by Seiko Instruments, Inc.) in compliance with a method defined under ASTM D3418-82.

From a point of view of particle size distribution and a shape of toner particles, as well as powder fluidity, heat-resistant storage stability, and resistance to stress of the electrostatic latent image developer, the second resin has a melting point preferably not lower than a temperature during manufacturing of the electrostatic latent image developer. Thus, toner particles are prevented from uniting with each other and breaking of the toner particles is prevented. In addition, since a narrow width of distribution in particle size distribution of toner particles is achieved, variation in particle size of toner particles is suppressed.

Mn of the second resin is preferably from 100 to 5000000, more preferably from 200 to 5000000, and further preferably from 500 to 500000. The method of measuring Mn is as described above.

The second resin has an SP value preferably from 7 to 18 $(cal/cm^3)^{1/2}$ and more preferably from 8 to 14 $(cal/cm^3)^{1/2}$.

From a point of view of fixability at a low temperature, toner particles contained in the dry developer preferably contain a polyester resin and more preferably contain a crystalline polyester resin, however, they may contain an amorphous polyester resin.

<Crystalline Polyester Resin>

A crystalline polyester resin is dissolved compatibly with an amorphous polyester resin at the time of melt and significantly lowers viscosity of toner. Therefore, use of the crystalline polyester resin will produce toner particles higher in fixability at a low temperature. When toner particles contain a crystalline polyester resin, in order to improve sharp-melting capability, the crystalline polyester resin is more preferably an aliphatic crystalline polyester resin composed of an aliphatic monomer.

In the present embodiment, the toner particles contain preferably 55 mass % or more and more preferably 60 mass % or more of the crystalline polyester resin. When a content of the crystalline polyester resin is not lower than 55 mass %, melt characteristics (described above) of the toner particles are expressed during melt, that is, toner particles satisfy A to C above. Therefore, fixability at a low temperature is improved by controlling a pressure during fixation.

The crystalline polyester resin has a melting point (a softening start temperature) preferably not lower than 50° C. and not higher than 90° C., more preferably not lower than 55° C. and not higher than 90° C., and further preferably not lower than 60° C. and not higher than 90° C. When this softening start temperature is not lower than 50° C., storability of toner particles or storability of a toner image after fixation is excellent. When the softening start temperature is not higher than 90° C., fixability at a low temperature is further improved.

The "crystalline polyester resin" herein refers to a crystalline polyester resin which does not show stepwise change in amount of heat absorption but has a clear heat absorption peak in the DSC method.

Such a crystalline polyester resin is synthesized from an acid (dicarboxylic acid) component and an alcohol (diol) component. A "constituent derived from an acid" below refers to a constitutional site in a polyester resin which has been an acid component before synthesis of the polyester resin. A "constituent derived from alcohol" refers to a constitutional site in a polyester resin which has been an alcohol component before synthesis of the polyester resin.

(Constituent Derived from Acid)

An acid to be a constituent derived from an acid is exemplified by various types of dicarboxylic acids, and for example, straight-chain aliphatic dicarboxylic acid is preferred.

Though straight-chain aliphatic dicarboxylic acid is not particularly limited, it is preferably, for example, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, or 1,18-octadecanedicarboxylic acid, and may be ester of lower alkyl thereof or an acid anhydride thereof. In consideration of availability, adipic acid, sebacic acid, or 1,10-decanedicarboxylic acid is more preferred.

The constituent derived from an acid may contain a constituent such as a constituent derived from dicarboxylic acid having double bond or a constituent derived from dicarboxylic acid having a sulfonic acid group.

(Constituent Derived from Alcohol)

Aliphatic diol is preferred as alcohol to be a constituent derived from alcohol. For example, though ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, or 1,20-eicosanediol is preferred, limitation thereto is not intended. In consideration of availability or cost, 1,4-butanediol, 1,6-hexanediol, 1,8-octanediol, 1,9-nonanediol, or 1,10-decanediol is more preferred.

<Amorphous Polyester Resin>

An amorphous polyester resin which can suitably be employed in the present embodiment is preferably obtained mainly through condensation polymerization between polyvalent carboxylic acids and polyalcohols.

Polyvalent carboxylic acids are preferably, for example, aromatic carboxylic acids such as terephthalic acid, isophthalic acid, phthalic anhydride, trimellitic anhydride, pyromellitic acid, or naphthalene dicarboxylic acid. Aliphatic carboxylic acids such as maleic anhydride, fumaric acid, succinic acid, alkenyl succinic anhydride, or adipic acid may be employed, or alicyclic carboxylic acids such as cyclohexanedicarboxylic acid may be employed. As polyvalent carboxylic acids, any one of carboxylic acids may be employed alone, or two or more of them may be employed together. Among them, aromatic carboxylic acid is more preferably employed. In order to have a cross-linking structure or a branched structure for the purpose to ensure good fixability, carboxylic acid which is trivalent or higher (trimellitic acid or an acid anhydride thereof) may be employed together with dicarboxylic acid.

Polyalcohols are preferably, for example, aliphatic diols such as ethylene glycol, diethylene glycol, triethylene glycol, propylene glycol, butanediol, hexanediol, neopentyl glycol, or glycerin. Alicyclic diols such as cyclohexanediol, cyclohexanedimethanol, or hydrogenated bisphenol A may be employed, or aromatic diols such as an adduct of ethylene oxide to bisphenol A or an adduct of propylene oxide to bisphenol A may be employed. As polyalcohols, any one of alcohols may be employed alone, or two or more of them may be employed together. Among them, aromatic diols or alicyclic diols are more preferably employed, and aromatic diol is further preferably employed. In order to have a cross-linking structure or a branched structure for the purpose to ensure better fixability, polyalcohol which is trivalent or higher (such as glycerin, trimethylolpropane, or pentaerythritol) may be employed together with diol.

The amorphous polyester resin has a glass transition point (which may hereinafter be denoted as "Tg") preferably not lower than 50° C. and not higher than 80° C. and more preferably not lower than 50° C. and not higher than 70° C. When Tg is not higher than 80° C., fixability at a low temperature is excellent. When Tg is not lower than 50° C., heat-resistant storability is excellent and storability of a fixed image is excellent.

In the present embodiment, the toner particles contain preferably 45 mass % or less and more preferably 40 mass % or less of the amorphous polyester resin. When a content of the amorphous polyester resin in the toner particles is within the range above, sharp-melting capability characterizing a crystalline resin and hardness and elasticity characterizing a non-crystalline resin can be provided, and hence fixability at a low temperature and stable fixation quality can further suitably be obtained.

An acid value of the amorphous polyester resin is preferably not lower than 5 mg KOH/g and not higher than 25 mg KOH/g. When this acid value is not lower than 5 mg KOH/g, affinity of toner to paper is excellent and chargeability is also excellent. When an acid value of the amorphous polyester resin is not higher than 25 mg KOH/g, adverse influence on dependency of charging on an environment can be prevented.

(Method of Manufacturing Polyester Resin)

A method of manufacturing a polyester resin is not particularly limited, and a general polyester polymerization method in which an acid component and an alcohol component are caused to react with each other is preferred. Preferably, a polyester resin is manufactured by selectively using direct polycondensation or ester exchange, depending on a type of a monomer.

A catalyst which can be employed in manufacturing of a polyester resin may be, for example, an alkali metal compound containing sodium or lithium, an alkali earth metal compound containing magnesium or calcium, or a metal compound containing zinc, manganese, antimony, titanium, tin, zirconium, or germanium. A phosphite compound, a phosphoric acid compound, or an amine compound may be employed.

A resin other than a polyester resin may be employed together as a binding resin. Other resins may be, for example, an ethylene-based resin such as polyethylene or polypropylene, a styrene-based resin such as polystyrene or α-polymethylstyrene, or a (meth)acrylic resin such as polymethyl methacrylate or polyacrylonitrile. A polyamide resin, a polycarbonate resin, a polyether resin, or a copolymerized resin thereof may be employed.

<Coloring Agent>

A coloring agent contained in a liquid developer and a coloring agent contained in a dry developer each have a particle size preferably not larger than 0.3 μm. Then, lowering in dispersibility of the coloring agent is prevented and hence a high degree of gloss can be maintained. Therefore, a desired color can be realized.

Though a conventionally known pigment can be employed as a coloring agent to be contained in a liquid developer and a coloring agent to be contained in a dry developer without being particularly limited, from a point of view of safety, cost, light resistance, coloring capability, and the like, pigments below are preferably employed. In terms of color construction, these pigments are normally categorized into a black pigment, a yellow pigment, a magenta pigment, or a cyan pigment, and colors (color images) other than black are basically toned by subtractive color mixture of a yellow pigment, a magenta pigment, or a cyan pigment. A pigment shown below may be used alone, or two or more types of pigments shown below may be used together as necessary.

A pigment contained in a black coloring agent (a black pigment) may be, for example, carbon black such as furnace black, channel black, acetylene black, thermal black, or lamp black, carbon black derived from biomass, or magnetic powders of magnetite or ferrite. Nigrosine (an azine-based compound) which is a purple-black dye may be used alone or in combination. As nigrosine, C. I. Solvent Black 7 or C. I. Solvent Black 5 can be employed.

A pigment contained in a magenta coloring agent (a magenta pigment) is preferably, for example, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, or C. I. Pigment Red 222.

A pigment contained in a yellow coloring agent (a yellow pigment) is preferably, for example, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 180, or C. I. Pigment Yellow 185.

A pigment contained in a cyan coloring agent (a cyan pigment) is preferably, for example, C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, C. I. Pigment Blue 62, C. I. Pigment Blue 66, or C. I. Pigment Green 7.

(Additive)

Toner particles contained in a liquid developer may contain as necessary an additive such as a dispersant for pigment, other than the resin and the coloring agent. A dispersant for pigment has a function to uniformly disperse a coloring agent (a pigment) in toner particles and it is preferably a basic dispersant. The basic dispersant refers to a dispersant defined below. Namely, 0.5 g of a dispersant for pigment and 20 ml of distilled water are introduced in a screw bottle made of glass, the screw bottle is shaken for 30 minutes with the use of a paint shaker, and the resultant product is filtered. pH of a filtrate obtained through filtration is measured with a pH meter (a trade name: "D-51" manufactured by Horiba, Ltd.), and a filtrate of which pH is higher than 7 is defined as a basic dispersant. It is noted that a filtrate of which pH is lower than 7 is referred to as an acid dispersant.

A type of such a basic dispersant is not particularly limited. For example, a basic dispersant is preferably a compound (dispersant) having a functional group such as an amine group, an amino group, an amide group, a pyrrolidone group, an imine group, an imino group, a urethane group, a quaternary ammonium group, an ammonium group, a pyridino group, a pyridium group, an imidazolino group, or an imidazolium group in a molecule. It is noted that what is called a surfactant having a hydrophilic portion and a hydrophobic portion in a molecule normally falls under the dispersant, however, various compounds can be employed, so long as they have a function to disperse a coloring agent (a pigment) as described above.

A commercially available product of such a basic dispersant may be, for example, "Ajisper PB-821" (trade name), "Ajisper PB-822" (trade name), or "Ajisper PB-881" (trade name), manufactured by Ajinomoto Fine-Techno Co., Inc., or "Solsperse 28000" (trade name), "Solsperse 32000" (trade name), "Solsperse 32500" (trade name), "Solsperse 35100" (trade name), or "Solsperse 37500" (trade name), manufactured by Japan Lubrizol Limited. Since a dispersant for pigment is more preferably not dissolved in an insulating liquid, for example, "Ajisper PB-821" (trade name), "Ajisper PB-822" (trade name), or "Ajisper PB-881" (trade name), manufactured by Ajinomoto Fine-Techno Co., Inc. is more preferred. By using such a dispersant for pigment, it becomes easier to obtain toner particles having a desired shape, although a reason is not known.

Preferably 1 to 100 mass % and more preferably 1 to 40 mass % of such a dispersant for pigment is added to the coloring agent (pigment). When an amount of addition of the dispersant for pigment is lower than 1 mass %, dispersibility of the coloring agent (pigment) may be insufficient. Therefore, necessary ID (image density) cannot be achieved in some cases and fixation strength of toner particles may be lowered. When an amount of addition of the dispersant for pigment exceeds 100 mass %, the dispersant for pigment in an amount more than necessary for dispersing the pigment is added. Therefore, the excessive dispersant for pigment may be dissolved in the insulating liquid, which may adversely affect chargeability or fixation strength of toner particles. One type alone of such a dispersant for pigment may be used or two or more types may be mixed for use.

Toner particles contained in a dry developer may contain as necessary an additive such as a release agent, a charge control agent, inorganic fine particles (inorganic powders), or organic fine particles, other than the resin and the coloring agent. Though inorganic fine particles are added for various purposes, they are added to a dry developer for the purpose of providing fluidity.

The release agent may be, for example, a dialkyl ketone based wax such as a polyethylene wax, a paraffin wax, a microcrystalline wax, a Fischer-Tropsch wax, or distearyl ketone, an ester based wax such as a carnauba wax, a montan wax, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, tristearyl trimellitate, or distearyl maleate, or an amide based wax such as ethylenediamine dibehenyl amide or trimellitic acid tristearylamide. Such a release agent is contained preferably by 2 mass % or more and 30 mass % or less and more preferably by 5 mass % or more and 20 mass % or less to the total mass of the toner particles.

The charge control agent may be, for example, a quaternary ammonium salt compound or a nigrosine-based compound, a dye composed of a complex of aluminum, iron, or chromium, or a triphenylmethane-based pigment.

(External Additive)

Toner particles contained in a dry developer may be obtained by treating a toner base material containing a resin and a coloring agent with such an external additive as a fluidizer or a cleaning aid. The external additive is preferably, for example, silica fine particles of which surface has been hydrophobized, titanium oxide fine particles, alumina fine particles, or cerium oxide fine particles. One of them alone may be employed, or two or more of them as being mixed may be employed. Hydrophobization treatment means, for example, treatment with a silane-based coupling agent, a titanium-based coupling agent, or silicone oil. As an aid for the purpose of improvement in ease of cleaning, zinc stearate may be employed together, a metallic soap such as calcium stearate or magnesium stearate may be employed together, or an abrasive such as strontium titanate, calcium titanate, or magnesium titanate may be employed together.

<Shape of Toner Particles>

Toner particles contained in a liquid developer preferably have a median diameter not smaller than 0.5 μm and not greater than 5.0 μm based on volume (hereinafter simply denoted as a "median diameter"). If a median diameter is smaller than 0.5 μm, toner particles have too small a particle size and hence mobility of toner particles in electric field may become poor, which may hence lead to lowering in development performance. If a median diameter exceeds 5.0 μm, uniformity in particle size of toner particles may be lowered, which may hence lead to lowering in image quality. More preferably, toner particles have a median diameter not smaller than 0.5 μm and not greater than 2.0 μm.

The median diameter means D50 found through measurement of particle size distribution of toner particles based on volume. The median diameter of toner particles contained in a liquid developer can be measured, for example, with a flow particle image analyzer (FPIA-3000S manufactured by Sysmex Corporation). This analyzer can use a solvent as it is as a dispersion medium. Therefore, this analyzer can measure a state of toner particles in a state closer to an actually dispersed state, as compared with a system in which measurement is conducted in a water system.

From a point of view of chargeability and image quality, toner particles contained in a dry developer have a median diameter preferably not smaller than 2.0 μm and not greater than 8.0 μm and more preferably not smaller than 3.0 μm and not greater than 7.0 μm. When a median diameter is not smaller than 2.0 lowering in fluidity of the toner particles can be prevented and high chargeability of toner particles can be maintained. In addition, since wider distribution of charging can be prevented, fogging over a background can be prevented and spill of the toner particles from a development apparatus can be prevented. When a median diameter is not greater than 8.0 lowering in resolution can be prevented and hence high image quality can be maintained.

Measurement of a median diameter of toner particles contained in a dry developer can be conducted in accordance with a method shown below. Initially, toner particles are placed in an aqueous solution of an electrolyte (an isotone aqueous solution), and ultrasound is applied to the solution for 30 seconds or longer. Then, Multisizer III (manufactured by Beckman Coulter) with an aperture diameter of 50 μm is used to measure a median diameter of toner particles contained in the dry developer.

<Core/Shell Structure>

Toner particles contained in a liquid developer preferably have a core/shell structure. The "core/shell structure" is such a structure as having the first resin as a core and the second resin as a shell. The core/shell structure includes not only such a structure that the second resin covers at least a part of surfaces of first particles (the first particles containing the first resin) but also such a structure that the second resin adheres to at least a part of surfaces of the first particles. When the toner particles have the core/shell structure, a median diameter of toner particles and circularity of toner particles are readily controlled.

Toner particles contained in a dry developer also preferably have a core/shell structure. In the toner particles contained in the dry developer, however, the core resin is not the first resin but is preferably a polyester resin and more preferably a crystalline polyester resin. The shell resin is not the second resin but is preferably an amorphous polyester resin. The core resin and the shell resin may be made of the same material. As the toner particles contained in the dry developer have the core/shell structure, fixability, heat-resistant storability, and chargeability can be enhanced.

In the core/shell structure of the toner particles used for the dry developer, a mass ratio between a shell resin (the second resin) and a core resin (the first resin) is preferably from 1:99 to 70:30. When a ratio of content of the second resin in the resin contained in the toner particles is lower than 1 mass %, resistance to blocking of the toner particles may lower. When a ratio of content of the first resin in the resin contained in the toner particles exceeds 99 mass %, uniformity in particle size of the toner particles may lower. From a point of view of uniformity in particle size of toner particles and heat-resistant stability of an electrostatic latent image developer, a mass ratio between the shell resin and the core resin is more preferably from 2:98 to 50:50 and further preferably from 3:97 to 35:65.

From a point of view of particle size distribution of toner particles and heat-resistant stability of the electrostatic latent image developer, a content of the shell resin in the toner particles is preferably from 1 to 50 mass %, more preferably from 5 to 30 mass %, and further preferably from 10 to 25 mass %. A content of the core resin in the toner particles is preferably from 50 to 99 mass %, more preferably from 70 to 95 mass %, and further preferably from 75 to 90 mass %.

When a resin contains shell particles made of the shell resin (the second resin) in a liquid developer and a dry developer, a method of manufacturing shell particles is preferably a method shown in any of [1] to [7] below. From a point of view of ease in manufacturing of the shell particles, the method of manufacturing the shell particles is preferably a method shown in [4], [6], or [7] below and more preferably a method shown in [6] or [7] below.

[1]: The second resin is crushed with a dry method with the use of a known dry type crusher such as a jet mill.

[2]: Powders of the second resin are dispersed in an organic solvent, and the resultant product is crushed with a wet method with the use of a known wet type disperser such as a bead mill or a roll mill.

[3]: A solution of the second resin is sprayed and dried with the use of a spray dryer or the like.

[4]: A poor solvent is added to a solution of the second resin or the solution is cooled, to thereby supersaturate and precipitate the second resin.

[5]: A solution of the second resin is dispersed in water or an organic solvent.

[6]: A precursor of the second resin is polymerized in water with an emulsion polymerization method, a soap-free emulsion polymerization method, a seed polymerization method, a suspension polymerization method, or the like.

[7]: A precursor of the second resin is polymerized in an organic solvent through dispersion polymerization or the like.

In a liquid developer and a dry developer, a median diameter of the shell particles is preferably adjusted as appropriate in order to achieve a desired value for a particle size of toner particles. For example, a median diameter of the shell particles is preferably from 0.0005 μm to 1 μm. The upper limit of the median diameter of the shell particles is more preferably 0.5 μm and further preferably 0.3 μm. The lower limit of the median diameter of the shell particles is more preferably 0.01 μm, further preferably 0.02 μm, and most preferably 0.04 μm. For example, in a case that toner particles having a median diameter of 1 μm are desirably obtained, the shell particles have a median diameter preferably from 0.0005 μm to 3 μm and more preferably from 0.001 μm to 0.2 μm. For example, in a case that toner particles having a median diameter of 10 μm are desirably obtained, the shell particles have a median diameter preferably from 0.005 μm to 3 μm and more preferably from 0.05 μm to 2 μm.

In the liquid developer and the dry developer, the core resin (the first resin) has an SP value preferably from 8 to 16 $(cal/cm^3)^{1/2}$ and more preferably from 9 to 14 $(cal/Cm^3)^{1/2}$.

In the liquid developer, a coloring agent may be contained in the core resin or the shell resin, or in both of the core resin and the shell resin. In the dry developer, a coloring agent and a release agent are preferably contained in the core resin, and an external additive preferably adheres to a surface of toner particles.

<Insulating Liquid>

When an electrostatic latent image developer is a liquid developer, toner particles are dispersed in an insulating liquid. The insulating liquid has a resistance value preferably to such an extent as not distorting an electrostatic latent image (approximately from $10^{11}$ to $10^{16}$ Ω·cm) and preferably it is a solvent having low odor and toxicity. The insulating liquid is generally exemplified by aliphatic hydrocarbon, alicyclic hydrocarbon, aromatic hydrocarbon, halogenated hydrocarbon, or polysiloxane. In particular from a point of view of low odor, low harm, and cost, the insulating liquid is preferably a normal paraffin based solvent or an isoparaffin based solvent, and preferably Moresco White (a trade name, manufactured by MORESCO Corporation), Isopar (a trade name, manufactured by Exxon Mobil Corporation), Shellsol (a trade name, manufactured by Shell Chemicals Japan Ltd.), or IP Solvent 1620, IP Solvent 2028, or IP Solvent 2835 (each of which is a trade name and manufactured by Idemitsu Kosan Co., Ltd.).

<Carrier>

A carrier contained in a two-component developer of a dry developer is not particularly limited, and a known carrier can be employed. For example, the carrier may be a magnetic metal such as iron oxide, nickel, or cobalt, or a magnetic oxide such as ferrite or magnetite. As the carrier, a resin-coated carrier having a resin layer formed on a surface of a core material composed of the magnetic metal or the magnetic oxide may be employed, or a magnetic dispersion-type carrier in which fine powders composed of the magnetic metal or the magnetic oxide are dispersed in a resin may employed. Alternatively, a resin dispersion-type carrier in which a conductive material is dispersed in a matrix resin may be employed.

A resin contained in a resin-coated carrier is not particularly limited, and it is preferably, for example, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin made by organosiloxane bond, or a modification thereof. A fluorine resin, a polyester resin, polycarbonate, a phenol resin, or an epoxy resin may be employed.

A core material contained in a resin-coated carrier may be, for example, a magnetic metal such as iron, nickel, or cobalt, a magnetic oxide such as ferrite or magnetite, or glass beads. In order to use the carrier in a magnetic brush method, the core material is preferably made of a magnetic material. A volume average particle size of the core material contained in the carrier is generally from 10 to 200 μm and preferably from 25 to 100 μm.

As a method of forming a resin layer on a surface of the core material, a method of dissolving a resin forming a resin layer and various additives (as necessary) in an appropriate solvent to thereby obtain a solution for forming the resin layer and applying the solution for forming the resin layer to the surface of the core material is exemplified. A solvent is not particularly limited, and a solvent is preferably selected as appropriate in consideration of a material for the resin layer to be formed on the surface of the core material or suitability of application.

From a point of view of chargeability of toner particles and storability of toner particles, a ratio of mixing (a mass ratio) between toner particles and a carrier is preferably from 1:100 to 30:100 and more preferably from 3:100 to 20:100.

<Manufacturing of Electrostatic Latent Image Developer>

When an electrostatic latent image developer is a liquid developer, a method of manufacturing a liquid developer preferably includes the step of dispersing toner particles in an insulating liquid.

Toner particles are preferably manufactured based on such a known technique as a crushing method or a granulation method. In the crushing method, resin particles and a pigment are molten and mixed and kneaded, and then the mixture is crushed. Crushing is preferably carried out in a dry state or a wet state such as in an insulating liquid.

The granulation method is exemplified, for example, by a suspension polymerization method, an emulsion polymerization method, a fine particle aggregation method, a method of adding a poor solvent to a resin solution for precipitation, a spray drying method, or a method of forming a core/shell structure with two different types of resins.

In order to obtain toner particles having a small diameter and sharp particle size distribution, the granulation method rather than the crushing method is preferably employed. A resin high in meltability or a resin high in crystallinity is soft even at a room temperature and less likely to be crushed.

Among the granulation methods, toner particles are preferably manufactured with a method shown below. Initially, a core resin solution (corresponding to a solution for forming a core resin in Examples) is obtained by dissolving a resin in a good solvent. Then, the core resin solution described above is mixed, together with an interfacial tension adjuster, in a poor solvent different in SP value from the good solvent, shear is provided, and thus a droplet is formed. Thereafter, by volatilizing the good solvent, particles made of the core resin are obtained. With this method, a particle size or a shape of toner particles can readily be controlled by varying how to provide shear, difference in interfacial tension, or an interfacial tension adjuster (a material for the shell resin). Therefore, toner particles having desired particle size distribution are likely to be obtained. A liquid developer as the electrostatic latent image developer is thus obtained.

When an electrostatic latent image developer is a dry developer, the dry developer can be manufactured with a dry granulation method such as a method of kneading and crushing. In the method of kneading and crushing, a resin and a release agent are mixed and kneaded, and then the mixture is crushed. Thereafter, classification is made to thereby adjust a particle size to a desired size. A surface of particles thus obtained may be covered with coating resin particles finely particulated in advance, with the use of a powder surface modification apparatus such as a hybridizer.

A dry developer, however, is preferably manufactured with such a wet granulation method as an emulsion aggregation method, a melt suspension method, or a dissolution suspension method. A method of manufacturing a dry developer with the emulsion aggregation method will be described below.

The method of manufacturing a dry developer with the emulsion aggregation method has the steps of forming emulsified particles (droplets) by emulsifying a source material forming toner particles (an emulsification step), forming an aggregate of the emulsified particles (droplets) (an aggregation step), forming a coating layer (a coating layer formation step), and fusing the aggregate having the coating layer formed (a fusion step). The dry developer may be formed without performing the coating layer formation step.

(Emulsification Step)

In the present step, a dispersion liquid of resin particles, a dispersion liquid of a coloring agent, and a dispersion liquid of a release agent are prepared. The release agent may be contained in the resin particles. As necessary, a dispersion liquid of resin particles containing a release agent, an internal additive, a charge control agent, or inorganic powders may be prepared.

(Preparation of Dispersion Liquid of Resin Particles)

Initially, an aqueous solvent and a crystalline polyester resin or an amorphous resin are mixed with each other. Then, shear force is applied to the obtained liquid mixture with the use of a disperser. The dispersion liquid of the resin particles is thus obtained. The disperser may be, for example, Homo Mixer (manufactured by Tokushu Kika Kogyo Co., Ltd.), or may be a continuous emulsifier such as Slasher (manufactured by Mitsui Mining Co., Ltd.), Cavitron (manufactured by Eurotec Co., Ltd.), Microfluidizer (manufactured by Mizuho Industrial Co., Ltd.), Manton-Gaulin homogenizer (Gaulin), Nanomizer (manufactured by Nanomizer Inc.), or a static mixer (Noritake Co., Limited).

When a crystalline polyester resin or an amorphous resin is dissolved in a solvent relatively low in solubility in water (for example, an oil-based solvent), a liquid mixture may be prepared in accordance with a method shown below. Initially, a crystalline polyester resin or an amorphous resin is dissolved in an oil-based solvent. The obtained solution is introduced in an aqueous solvent together with a dispersant or a high-polymer electrolyte. Thus, fine particles made of the crystalline polyester resin or the amorphous resin are dispersed in the aqueous solvent. Thereafter, the oil-based solvent is evaporated under heating or pressure reduction.

The aqueous solvent may be, for example, distilled water or ion exchanged water, or may be alcohols. As the aqueous solvent, one of them alone may be employed, or two or more of them may be employed together. In consideration of stability in charging and shape controllability of resin particles, the aqueous solvent is preferably water such as distilled water or ion exchanged water. The aqueous solvent preferably contains a surfactant.

Though the surfactant is not particularly limited, it may be, for example, an anionic surfactant which is based on a sulfuric acid ester salt, sulfonate, phosphate, or soap, a cationic surfactant based on an amine salt or a quaternary ammonium salt, or a nonionic surfactant which is based on polyethylene glycol, an adduct of ethylene oxide to alkyl phenol, or polyhydric alcohol. Among them, an ionic surfactant such as an anionic surfactant or a cationic surfactant is preferred, and a nonionic surfactant is preferably used together with an anionic surfactant or a cationic surfactant. One of them alone may be employed as the surfactant, or two or more of them may be employed together.

The anionic surfactant is preferably, for example, sodium dodecylbenzenesulfonate, sodium dodecyl sulfate, sodium alkylnaphthalene sulfonate, or sodium dialkylsulfosuccinate.

The cationic surfactant is preferably, for example, alkylbenzenedimethylammonium chloride, alkyltrimethyl ammonium chloride, or distearyl ammonium chloride.

In preparing a dispersion liquid of resin particles with the use of a polyester resin, a phase inversion emulsification method is preferably made use of. In preparing a dispersion liquid of resin particles with the use of a resin other than the polyester resin as well, the phase inversion emulsification method can be made use of. In the phase inversion emulsification method, initially, a resin to be dispersed is dissolved in a hydrophobic organic solvent in which the resin is soluble. A base is added to the organic solvent (an organic continuous phase (an O phase)) for neutralization, and then an aqueous solvent (a W phase) is added. Thus, inversion of a resin from W/O to O/W (what is called phase inversion) is achieved and a discontinuous phase is achieved. Then, the resin becomes particulate and is dispersed in the aqueous solvent and stabilized.

An organic solvent used in the phase inversion emulsification method may be, for example, alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol, or cyclohexanol, ketones such as methyl ethyl ketone, methyl isobutyl ketone, ethyl butyl ketone, cyclohexanone, or isophoron, ethers such as tetrahydrofuran, dimethyl ether, diethyl ether, or dioxane, esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl bromide, dimethyl bromide, dimethyl succinate, diethyl succinate, diethyl carbonate, or dimethyl carbonate, glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate, or dipropylene glycol monobutyl ether, 3-methoxy-3-methyl butanol, 3-methoxy butanol, acetonitrile, dimethylformamide, dimethylacetamide, diacetone alcohol, or ethyl acetoacetate. One of them alone may be employed, or two or more of them may be employed together.

A difference in physical property of a resin leads to a difference in amount of an organic solvent for obtaining resin particles having a desired particle size. When an amount of an organic solvent with respect to a mass of a resin is small, an emulsive property is insufficient, and hence increase in particle size of the resin particles or broader distribution of a particle size of the resin particles may be caused.

When resin particles are dispersed in an aqueous solvent, some or all of carboxyl groups in resin molecules are preferably neutralized with a neutralizer as necessary. The neutralizer may be, for example, an inorganic alkali such as potassium hydroxide or sodium hydroxide, or amines such as ammonia, monomethylamine, dimethylamine, triethylamine, monoethylamine, diethylamine, triethylamine, mono-n-propylamine, dimethyl n-propylamine, monoethanolamine, dimethanolamine, triethanolamine, N-methylethanolamine, N-aminoethylethanolamine, N-methyldiethanolamine, monoisopropanolamine, diisopropanolamine, triisopropanolamine, or N,N-dimethylpropanolamine. One of them alone may be employed, or two or more of them may be employed together. Since pH at the time of emulsification is adjusted to a level around neutral by addition of a neutralizer, hydrolysis of a dispersion liquid of resin particles can be prevented.

In order to stabilize resin particles or to prevent an aqueous solvent from being thickened, a dispersant may be added at the time of phase inversion emulsification. The dispersant may be, for example, a water-soluble high polymer such as polyvinyl alcohol, methyl cellulose, ethyl cellulose, hydroxyethyl cellulose, carboxymethyl cellulose, sodium polyacrylate, or sodium polymethacrylate, an anionic surfactant such as sodium dodecylbenzenesulfonate, sodium octadecyl sulfate, sodium oleate, sodium laurate, or potassium stearate, a cationic surfactant such as lauryl amine acetate, stearyl amine acetate, or lauryl trimethyl ammonium chloride, an ampholytic surfactant such as lauryldimethylamine oxide, a nonionic surfactant such as polyoxyethylene alkyl ether, polyoxyethylene alkylphenyl ether, or polyoxyethylene alkyl amine, or an inorganic compound such as tricalcium phosphate, aluminum hydroxide, calcium sulfate, calcium carbonate, or barium carbonate. One of them alone may be employed, or two or more of them may be employed together. A dispersant is added preferably by 0.01 mass % or more and 20 mass % or less with respect to 100 mass % of a resin.

An emulsification temperature at the time of phase inversion emulsification is preferably not higher than a boiling point of an organic solvent and not lower than a melting point or a glass transition point of a resin. When the emulsification temperature is lower than the melting point or the glass transition point of the resin, preparation of the dispersion liquid of the resin particles becomes difficult. When emulsification is carried out in a pressurized and sealed apparatus, an emulsification temperature may be set to be higher than the boiling point of the organic solvent.

Preferably 5 mass % or more and 50 mass % or less and more preferably 10 mass % or more and 40 mass % or less of resin particles is contained in the dispersion liquid of the resin particles. When a content of the resin particles is within the range above, distribution of a particle size of the resin particles can be prevented from spreading and deterioration in characteristics can be prevented.

A volume average particle size of the resin particles dispersed in the dispersion liquid of the resin particles is preferably not smaller than 0.01 μm and not larger than 1 μm, more preferably not smaller than 0.02 μm and not larger than 0.8 μm, and further preferably not smaller than 0.03 μm and not larger than 0.6 μm. When this volume average particle size exceeds 1 μm, distribution of a particle size of toner may be broader. In addition, free particles may be produced. When the volume average particle size is within the range above, such a disadvantage can be avoided. In addition, since unevenness in composition in toner particles is lessened, dispersion of toner particles in a dry developer is good. Therefore, high performance and reliability of the dry developer can be maintained. Such a volume average particle size can be measured, for example, with a laser diffraction particle size distribution analyzer (a model number "LA-700" manufactured by Horiba, Ltd.).

When resin particles are made of a polyester resin, the obtained dispersion liquid of the resin particles has self-water-dispersibility with functional groups which can be anionic through neutralization being included, in which some or all of functional groups which can be hydrophilic are neutralized with a base, and it is stabilized by a function of an aqueous medium.

A functional group which can be a hydrophilic group through neutralization in a polyester resin is, for example, an acid group such as a carboxyl group or a sulfone group. Therefore, a neutralizer may be, for example, an inorganic base such as sodium hydroxide, potassium hydroxide, lithium hydroxide, calcium hydroxide, sodium carbonate, or ammonia, or may be an organic base such as diethylamine, triethylamine, or isopropylamine.

(Preparation of Dispersion Liquid of Coloring Agent)

A method of dispersing a coloring agent is not particularly limited, and the coloring agent can be dispersed with the use of a general disperser such as a rotary-shear homogenizer, a ball mill having a medium, a sand mill, or a dyno mill. A surfactant or a dispersant listed in Preparation of Dispersion Liquid of Resin Particles can be employed as necessary.

A coloring agent is contained in a dispersion liquid of the coloring agent preferably by 3 mass % or more and 50 mass % or less and more preferably by 5 mass % or more and 40 mass % or less. When a content of the coloring agent is within the range above, distribution of a particle size of particles composed of the coloring agent can be prevented from spreading, and hence deterioration in characteristics can be prevented.

A volume average particle size of particles of the coloring agent dispersed in the dispersion liquid of the coloring agent is preferably not larger than 1 μm and more preferably not smaller than 0.01 μm and not larger than 0.5 μm. When this volume average particle size exceeds 1 μm, distribution of a particle size of toner particles may be broader. In addition, free particles may be produced. When the volume average particle size is within the range above, however, such a disadvantage can be avoided. In addition, since unevenness in composition in toner particles is lessened, dispersion of toner particles in a dry developer is good. Therefore, high performance and reliability of the dry developer can be maintained. Such a volume average particle size of the particles of the coloring agent can be measured, for example, with a laser diffraction particle size distribution analyzer (a model number "LA-700" manufactured by Horiba, Ltd.). This is also the case with particles of a release agent dispersed in a dispersion liquid of the release agent.

(Preparation of Dispersion Liquid of Release Agent)

A dispersion liquid of a release agent can be prepared in accordance with a method similar to the method described in Preparation of Dispersion Liquid of Resin Particles. Thus, a dispersion liquid of the release agent in which particles of the release agent having a volume average particle size not larger than 1 μm are dispersed can be obtained. A surfactant or a dispersant listed in Preparation of Dispersion Liquid of Resin Particles can be employed as necessary.

(Aggregation Step)

A dispersion liquid of source materials is obtained by adding the dispersion liquid of the coloring agent to the dispersion liquid of the resin particles and then adding another dispersion liquid (for example, the dispersion liquid of the release agent) as necessary. An aggregation agent is added to this dispersion liquid of the source materials and then the dispersion liquid is heated. When the resin particles are crystalline resin particles made of a crystalline polyester resin, the dispersion liquid of the source materials is heated at a temperature not higher than a melting point of the crystalline resin. Aggregated particles formed through aggregation of these particles are thus formed.

The aggregation agent is added to the dispersion liquid of the source materials while the dispersion liquid of the source materials is stirred with the rotary-shear homogenizer at a room temperature, and pH of the dispersion liquid of the source materials is made acidic. Aggregated particles are thus formed. In order to avoid abrupt aggregation as a result of heating through stirring, pH of the dispersion liquid of the source materials may be adjusted to acidic while stirring is carried out. A dispersion stabilizer is preferably added as necessary.

An aggregation agent is preferably a surfactant reverse in polarity to a surfactant added as a dispersant to the dispersion liquid of the source materials. For example, the aggregation agent may be an inorganic metal salt or a metal complex which is divalent or higher. When a metal complex which is divalent or higher is employed, an amount of use of a surfactant can be decreased and hence charging characteristics are improved. A material forming a coordinate bond or a bond similar to the coordinate bond to metallic ions contained in the aggregation agent (an additive) can be employed as necessary. This additive is preferably, for example, a chelating agent.

The inorganic metal salt may be, for example, a metal salt such as calcium chloride, calcium nitrate, barium chloride, magnesium chloride, zinc chloride, aluminum chloride, or aluminum sulfate, or may be an inorganic metal salt polymer such as polyaluminum chloride, polyaluminum hydroxide, or calcium polysulfide. Among them, an aluminum salt or a polymer thereof is particularly preferably employed. In order to obtain sharper distribution of a particle size of toner particles, a valence of an inorganic metal salt is preferably higher, and when the valence is the same, an inorganic metal salt polymer of a polymerized type is preferred.

The chelating agent is preferably, for example, a water-soluble chelating agent. A water-soluble chelating agent is excellent in dispersibility in a dispersion liquid of source materials. Therefore, an effect originating from addition of an aggregation agent (capturing of metallic ions into toner particles) is effectively obtained. The water-soluble chelating agent is not particularly limited, and it may be, for example, oxycarboxylic acid such as tartaric acid, citric acid, or gluconic acid, or iminodiacetic acid (IDA), nitrilotris acetic acid (NTA), or ethylenediaminetetraacetic acid (EDTA).

The chelating agent is contained preferably by 0.01 mass % or more and 5.0 mass % or less and more preferably by 0.1 mass % or more and less than 3.0 mass % with respect to 100 mass % of the resin. When an amount of addition of the chelating agent is not lower than 0.01 mass %, an effect of addition of the chelating agent can effectively be obtained. When an amount of addition of the chelating agent exceeds 5.0 mass %, chargeability of toner particles may lower and viscoelasticity of toner particles may drastically change. Therefore, fixability at a low temperature or glossiness of an image may adversely be affected.

The chelating agent is added during or before or after the aggregation step, or during or before or after the coating layer formation step which will be described later. Therefore, in addition of the chelating agent, a temperature of the dispersion liquid of the source materials does not have to be adjusted. The chelating agent at a room temperature may be added, or the chelating agent may be added after a temperature of the chelating agent is adjusted to a temperature in a bath in the aggregation step or the coating layer formation step.

(Coating Layer Formation Step)

Resin particles are adhered to a surface of aggregated particles. For example, a resin dispersion liquid in which amorphous resin particles have been dispersed is added to the dispersion liquid of the source materials in which the aggregated particles have been formed. Thus, the coating layer made of the amorphous resin is formed on the surface of the aggregated particles, and hence toner particles having the core/shell structure are obtained.

An aggregation agent may further be added, or pH may be adjusted separately. In addition, a particle size or an amount of addition of amorphous resin particles is preferably adjusted such that a coating layer is sufficiently formed on the surface of the aggregated particles.

A coating layer may be formed in multiple steps, by alternately repeating the coating layer formation step and the fusion step which will be described later.

(Fusion Step)

The fusion step is performed after the aggregation step or the coating layer formation step. pH of a suspension containing aggregated particles is controlled approximately to 6.5 to 8.5. Thus, progress of aggregation stops.

When progress of aggregation stops, heating is carried out to fuse aggregated particles. When a crystalline resin is employed as a resin, heating at a temperature not lower than a melting point of the resin is preferably carried out. A shape of the aggregated particles is controlled through this heating. For example, heating approximately for 0.5 to 10 hours will achieve a desired shape of the aggregated particles.

When the aggregated particles have a desired shape, the aggregated particles are preferably cooled. Here, when the aggregated particles contain a crystalline polyester resin, a cooling rate is preferably decreased around a melting point thereof (what is called gradual cooling). Crystallization of the crystalline polyester resin is thus promoted.

(Cleaning and Drying)

After the fusion step, a cleaning step, a solid-liquid separation step, or a drying step is preferably performed. In the cleaning step, preferably, a dispersant adhering to the aggregated particles is removed with an aqueous solution of a strong acid such as muriatic acid, sulfuric acid, or nitric acid, and the aggregated particles are cleaned with ion exchanged water until a filtrate becomes neutral.

In the solid-liquid separation step, from a point of view of productivity, suction filtration or pressure filtration is preferably carried out.

In the drying step, from a point of view of productivity, freeze drying, flash jet drying, fluidized drying, or vibration-type fluidized drying is preferably carried out, however, a normal vibration-type fluidized drying method, a spray drying method, a freeze drying method, or a flash jet method may be carried out. In the drying step, a drying condition is adjusted such that a ratio of content of moisture in particles (toner particles) after drying is preferably not higher than 1.0 mass % and more preferably not higher than 0.5 mass %. An external additive described above is added to the dried particles as necessary. A dry developer as an electrostatic latent image developer is thus obtained.

<Transferring>

In a transferring step, an electrostatic latent image developer is transferred to a recording medium. An electrostatic latent image developer is preferably transferred to a recording medium with a conventionally known method.

<Fixation>

In a fixation step, toner particles contained in the electrostatic latent image developer transferred to the recording medium are fixed to the recording medium. The fixation step includes the steps of heating the recording medium and fixing toner particles to the recording medium at a pressure not lower than 200 kPa and not higher than 800 kPa. Toner particles are preferably fixed at a pressure not lower than 200 kPa and not higher than 800 kPa while the recording medium is heated.

<Pressurization>

When toner particles are fixed to a recording medium at a pressure not lower than 200 kPa and not higher than 800 kPa, an image having low image noise and a desired degree of gloss can be obtained. Specifically, when this pressure is not lower than 200 kPa, toner particles are sufficiently deformed during fixation. Therefore, an image having a desired degree of gloss is obtained. When this pressure is not higher than 800 kPa, excessive deformation of toner particles during fixation can be prevented. Since distortion in an edge portion of an image or in a line image is thus prevented, excellent image quality is achieved. Preferably, this pressure is not lower than 400 kPa. Thus, an image high in degree of gloss is obtained.

A storage elastic modulus of toner particles at 70° C. G'(70° C.) and a pressure P during fixation preferably satisfy the Expression (4) below. When a condition of $43.429 \ln\{G'(70° C.)\}-347.8 \leq P$ is satisfied, toner particles are readily deformed during fixation. Therefore, high fixation strength is maintained and an image excellent in glossiness is obtained. When a condition of $P \leq 43.429 \ln \{G'(70° C.)\} + 52.3$ is satisfied, excessive deformation of toner particles during fixation can be prevented and hence distortion in an edge portion of an image or in a line image can be kept low.

$$43.429 \ln \{G'(70° C.)\} - 347.8 \leq P \leq 43.429 \ln \{G'(70° C.)\} + 52.3 \quad \text{Expression (4)}$$

<Heating>

When a recording medium is heated, toner particles on the recording medium are heated. A heating condition is preferably controlled such that a temperature $T_1$ (° C.) of the recording medium after toner particles are fixed to the recording medium is not lower than 70° C. and not higher than 100° C. When $T_1$ (° C.) is not lower than 70° C., an image having a desired degree of gloss can be obtained. When $T_1$ (° C.) is not higher than 100° C., shrinkage of the recording medium due to change in content of moisture in the recording medium can be prevented.

Figure 3:
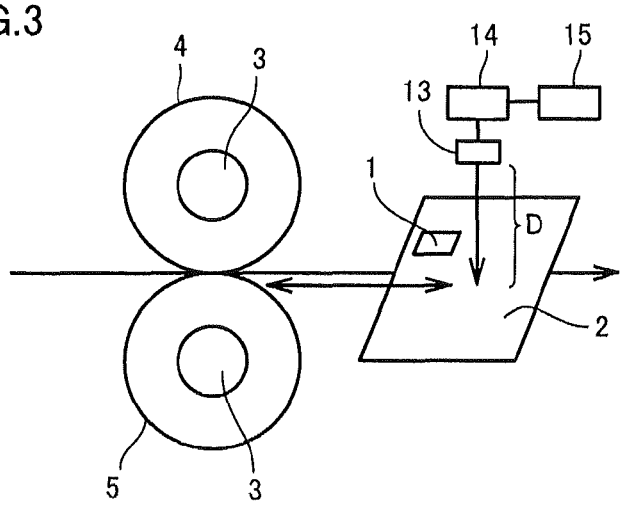
FIG. 3 is a side view schematically showing an apparatus for measuring $T_1$.

$T_1$ (° C.) represents a temperature of a recording medium (a portion where an image has not yet been formed) after lapse of 0.025 second since passage through a nipping portion formed between fixation rollers, and it can be measured with a method shown below. FIG. 3 is a side view schematically showing an apparatus for measuring $T_1$ (° C.). Initially, a recording medium (A4 size) 2 to which a liquid developer 1 has been transferred is passed between a first fixation roller 4 and a second fixation roller 5 at a velocity of 400 mm/s. Here, each of first fixation roller 4 and second fixation roller 5 is formed by forming an elastic layer around an outer circumferential surface of a core metal having an outer diameter of 35 mm, with the elastic layer having been formed by layering a polytetrafluoroethylene layer having a thickness of 1 mm on a surface of a silicone rubber layer having a thickness of 15 mm. Therefore, each of first fixation roller 4 and second fixation roller 5 has an outer diameter of 50 mm. Each of first fixation roller 4 and second fixation roller 5 contains a heating portion 3 such as a halogen lamp, and it is heated by this heating portion 3. Therefore, in the nipping portion formed between first fixation roller 4 and second fixation roller 5, recording medium 2 is heated and toner particles on recording medium 2 are heated.

Then, a digital radiation temperature sensor 13, a digital amplifier 14, and a personal computer 15 are used to find $T_1$ (° C.). Here, digital radiation temperature sensor 13 is arranged at a point distant by 35 mm from a surface of recording medium 2 (D shown in FIG. 3 being set to 35 mm) which has passed between first fixation roller 4 and second fixation roller 5, and it is implemented, for example, by "Thermopile FT-H10" manufactured by Keyence Corporation (emissivity: 0.95, response time: 0.03 second). Digital radiation temperature sensor 13 outputs a voltage in proportion to a local temperature difference or a temperature gradient, digital amplifier 14 amplifies the voltage from digital radiation temperature sensor 13, and personal computer 15 calculates $T_1$ (° C.) by operating data from digital amplifier 14. A point reached after lapse of 0.025 second since passage of recording medium 2 through the nipping portion formed between first fixation roller 4 and second fixation roller 5 is defined as a point of measurement of $T_1$ (° C.).

Figure 4:
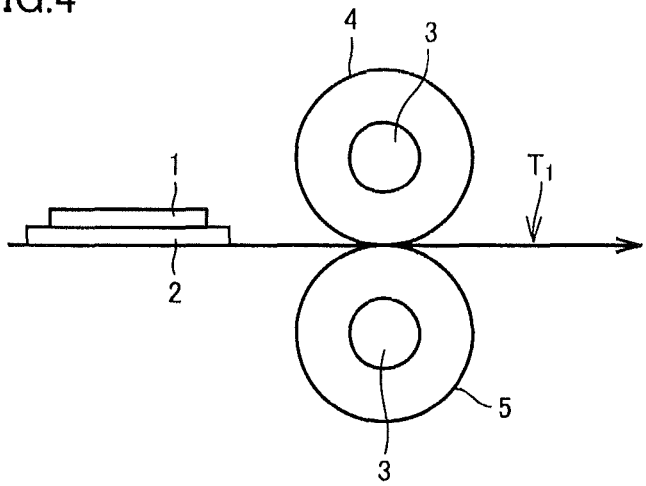
FIGS. 4 to 7 are side views each schematically showing one example of a fixer.
Figure 5:
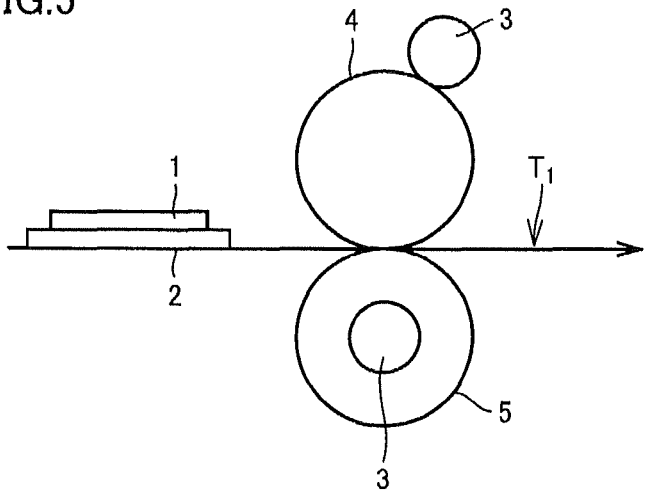
Figure 6:
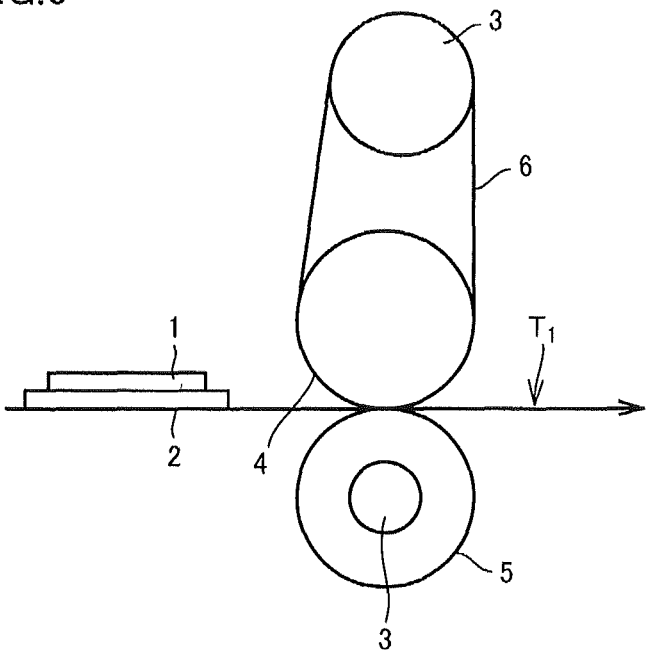

Heating may be contact heating or may be non-contact heating and contact heating as being combined. Contact heating means heating of a recording medium while a heat source (including a roller heated by the heat source) is in contact with the recording medium, and it can be carried out, for example, with the use of fixers shown in FIGS. 4 to 6. FIGS. 4 to 6 are side views each schematically showing one example of the fixer used for heating of a recording medium during fixation.

In the fixer shown in FIG. 4, each of first fixation roller 4 and second fixation roller 5 contains heating portion 3 and it is heated by heating portion 3. Thus, in the nipping portion formed between first fixation roller 4 and second fixation roller 5, recording medium 2 is heated and hence toner particles on recording medium 2 are heated. A temperature of first fixation roller 4 or second fixation roller 5 is preferably not lower than 80° C. and not higher than 130° C. Thus, $T_1$ (° C.) can be not lower than 70° C. and not higher than 100° C., which is also the case with the fixers shown in FIGS. 5 and 6.

In the fixer shown in FIG. 5, first fixation roller 4 is provided with external heating portion 3 and second fixation roller 5 contains heating portion 3. Even in such a case, each of first fixation roller 4 and second fixation roller 5 is heated by heating portion 3. Therefore, in the nipping portion formed between first fixation roller 4 and second fixation roller 5, recording medium 2 is heated and toner particles on recording medium 2 are heated.

In the fixer shown in FIG. 6, first fixation roller 4 is connected to heating portion 3 provided outside first fixation roller 4 with a belt 6 being interposed. Second fixation roller 5 contains heating portion 3. Even in such a case, each of first fixation roller 4 and second fixation roller 5 is heated by heating portion 3. Therefore, in the nipping portion formed between first fixation roller 4 and second fixation roller 5, recording medium 2 is heated and toner particles on recording medium 2 are heated.

When non-contact heating and contact heating are combined, contact heating is preferably carried out after non-contact heating. Non-contact heating means heating of a recording medium while a heat source (including a roller heated by the heat source) is not in contact with the recording medium.

When non-contact heating and contact heating are combined, the heating step is performed twice. Therefore, even when a sufficient amount of heat could not be provided to toner particles on recording medium 2 in contact heating, lowering in fixation strength can be prevented. Therefore, an image excellent in glossiness is obtained. In addition, occurrence of cold offset in contact heating can be prevented. As set forth above, when image formation processing is performed at a high speed or when two or more toner layers are formed as being superimposed on each other on a recording medium, contact heating is preferably carried out after non-contact heating.

Figure 7:
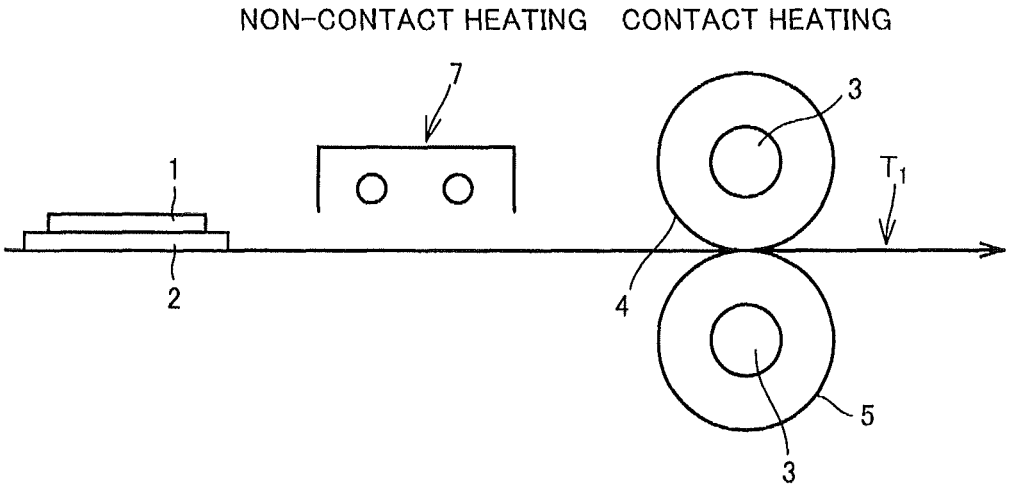

Non-contact heating and contact heating can be carried out as being combined, with the use of the fixer shown in FIG. 7. In the fixer shown in FIG. 7, for example, recording medium 2 is heated while a heat source 7 such as a halogen lamp is not in contact with recording medium 2, and thereafter recording medium 2 is heated while first fixation roller 4 and second fixation roller 5 heated by heating portion 3 are in contact with recording medium 2. A temperature of the heat source in non-contact heating is preferably not lower than 200° C. and not higher than 2000° C. A temperature of first fixation roller 4 or second fixation roller 5 is preferably not lower than 80° C. and not higher than 130° C. Thus, $T_1$ (° C.) can be not lower than 70° C. and not higher than 100° C.

[Image Formation Apparatus]

An image formation apparatus according to the present embodiment is an image formation apparatus capable of performing the image formation method according to the present embodiment, and includes an electrostatic latent image developer having toner particles satisfying A to C above, a transfer portion transferring the electrostatic latent image developer to a recording medium, a fixation portion fixing the toner particles contained in the electrostatic latent image developer transferred to the recording medium at the transfer portion to the recording medium, and a heating portion heating the recording medium at the fixation portion. The electrostatic latent image developer is preferably the liquid developer described above or the dry developer described above. The transfer portion preferably has a transfer mechanism shown in FIG. 8. The fixation portion and the heating portion preferably have the fixer and the heating portion, respectively, as shown in any of FIGS. 4 to 7.

Figure 8:
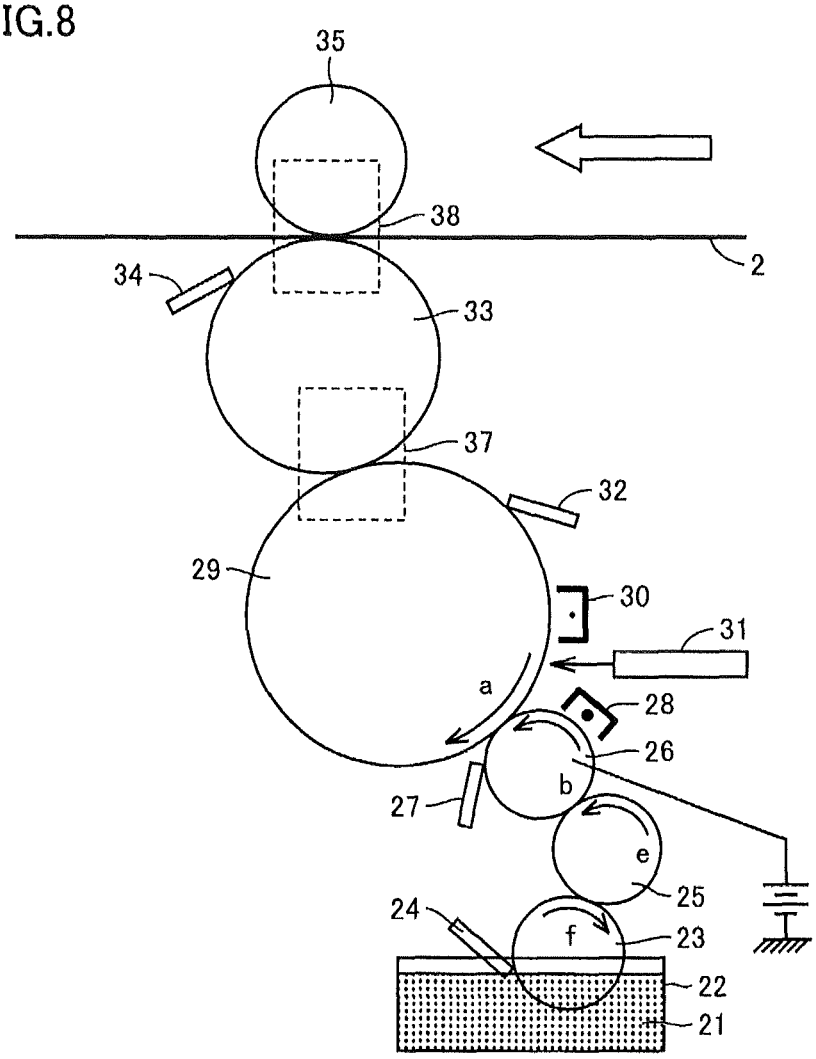
FIG. 8 is a schematic conceptual diagram of a part of an image formation apparatus of an electrophotography type.

FIG. 8 is a schematic conceptual diagram of a part of an image formation apparatus of an electrophotography type. In FIG. 8, a liquid developer 21 is brought up from a development tank 22 by an anilox roller 23. Excessive liquid developer 21 on anilox roller 23 is scraped off by an anilox restriction blade 24, and remaining liquid developer 21 is sent to a leveling roller 25. Liquid developer 21 is adjusted to be uniform and small in thickness, on leveling roller 25.

Liquid developer 21 on leveling roller 25 is sent to a development roller 26. Liquid developer 21 on development roller 26 is charged by a development charger 28 and developed on a photoconductor 29, and the excessive liquid developer on development roller 26 is scraped off by a development cleaning blade 27. Specifically, a surface of photoconductor 29 is evenly charged by a charging portion 30, and an exposure portion 31 arranged around photoconductor 29 emits light based on prescribed image information to the surface of photoconductor 29. Thus, an electrostatic latent image based on the prescribed image information is formed on the surface of photoconductor 29. As the formed electrostatic latent image is developed, a toner image is formed on photoconductor 29. The excessive liquid developer on photoconductor 29 is scraped off by a cleaning blade 32.

The toner image formed on photoconductor 29 is primarily transferred to an intermediate transfer element 33 at a primary transfer portion 37, and the liquid developer transferred to intermediate transfer element 33 is secondarily transferred to recording medium 2 at a secondary transfer portion 38. The liquid developer transferred to recording medium 2 is fixed, and the liquid developer which remained on intermediate transfer element 33 without being secondarily transferred is scraped off by an intermediate transfer element cleaning portion 34.

[Image Formation Method]

The image formation method according to the present embodiment is preferably an image formation method of a general electrophotography type. Specifically, a charging step of uniformly providing a charge potential to a surface of a latent image holder (for example, a surface of photoconductor 29), an exposure step of forming an electrostatic latent image on the surface of the latent image holder to which the charge potential has uniformly been provided, a development step of forming a toner image by developing the electrostatic latent image with toner particles, a transfer step of transferring the toner image to a recording medium, and a fixation step of fixing the toner image to the recording medium are preferably performed.

EXAMPLES

Though the present invention will be described hereinafter in further detail, the present invention is not limited thereto.

Examples of Liquid Developer

Manufacturing Example 1

Manufacturing of Dispersion Liquid (W1) of Shell Particles

In a beaker made of glass, 100 parts by mass of 2-decyltetradecyl(meth)acrylate, 30 parts by mass of methacrylic acid, 70 parts by mass of an equimolar reactant with hydroxyethyl methacrylate and phenyl isocyanate, and 0.5 part by mass of azobis methoxy dimethyl valeronitrile were introduced, and stirred and mixed at 20° C. Thus, a monomer solution was obtained.

Then, a reaction vessel provided with a stirring apparatus, a heating and cooling apparatus, a thermometer, a dropping funnel, a desolventizer, and a nitrogen introduction pipe was prepared. In that reaction vessel, 195 parts by mass of THF were introduced, and the monomer solution above was introduced in the dropping funnel provided in the reaction vessel. After a vapor phase portion of the reaction vessel was replaced with nitrogen, the monomer solution was dropped in THF in the reaction vessel for 1 hour at 70° C. in a sealed condition. Three hours after the end of dropping of the monomer solution, a mixture of 0.05 part by mass of azobis methoxy dimethyl valeronitrile and 5 parts by mass of THF was added to the reaction vessel and caused to react for 3 hours at 70° C. Thereafter, cooling to room temperature was carried out. Thus, a copolymer solution was obtained.

Four hundred parts by mass of the obtained copolymer solution were dropped in 600 parts by mass of IP Solvent 2028 (manufactured by Idemitsu Kosan Co., Ltd.) which was being stirred, and THF was distilled out at 40° C. at a reduced pressure of 0.039 MPa. By further diluting the obtained solution with IP Solvent 2028, a dispersion liquid (W1) of shell particles in which a concentration of a solid content was 25 mass % was obtained. A volume average particle size of the shell particles in the dispersion liquid (W1) was measured with a laser particle size distribution analyzer ("LA-920" manufactured by Horiba, Ltd.), which was 0.12 μm.

Manufacturing Example 2

Manufacturing of Solution (Y1) for Forming Core Resin

In a reaction vessel provided with a stirring apparatus, a heating and cooling apparatus, and a thermometer, 937 parts by mass of polyester resin (Mn: 6000) obtained from sebacic acid, adipic acid, and ethylene glycol (a molar ratio of 0.8:0.2:1) and 300 parts by mass of acetone were introduced and stirred for uniform solution in acetone. In the obtained solution, 63 parts by mass of IPDI were introduced and caused to react for 6 hours at 80° C. When an NCO value attained to 0, 28 parts by mass of terephthalic anhydride were further added and caused to react for 1 hour at 180° C. Thus, a core resin which was a urethane-modified polyester resin was obtained. Eight hundred parts by mass of the obtained core resin and 1200 parts by mass of acetone were stirred in a beaker, to thereby uniformly dissolve the core resin in acetone. Thus, a solution (Y1) for forming a core resin was obtained. The obtained core resin had Mn of 30000 and a concentration of a urethane group of 1.52%. A concentration of a solid content in the solution (Y1) for forming a core resin was 40 mass %.

Manufacturing Example 3

Manufacturing of Solution (Y2) for Forming Core Resin

In a reaction vessel provided with a stirring apparatus, a heating and cooling apparatus, and a thermometer, 937 parts by mass of polyester resin (Mn: 4000) obtained from sebacic acid, adipic acid, and ethylene glycol (a molar ratio of 0.8:0.2:1) and 300 parts by mass of acetone were introduced and stirred for uniform solution in acetone. In the obtained solution, 63 parts by mass of IPDI were introduced and caused to react for 6 hours at 80° C. When an NCO value attained to 0, 28 parts by mass of terephthalic anhydride were further added and caused to react for 1 hour at 180° C. Thus, a core resin which was a urethane-modified polyester resin was obtained. Eight hundred parts by mass of the obtained core resin and 1200 parts by mass of acetone were stirred in a beaker, to thereby uniformly dissolve the core resin in acetone. Thus, a solution (Y2) for forming a core resin was obtained. The obtained core resin had Mn of 11000 and a concentration of a urethane group of 1.78%. A concentration of a solid content in the solution (Y2) for forming a core resin was 40 mass %.

Manufacturing Example 4

Manufacturing of Amorphous Resin Solution (Y3)

In a reaction vessel provided with a stirring apparatus, a heating and cooling apparatus, and a thermometer, 937 parts by mass of polyester resin obtained from terephthalic acid and a 2-adduct of propylene oxide to bisphenol A (a molar ratio of 1:1) and 300 parts by mass of acetone were introduced and stirred for uniform solution in acetone. Eight hundred parts by mass of the obtained core resin and 1200 parts by mass of acetone were introduced and stirred in a beaker, to thereby uniformly dissolve the core resin in acetone. Thus, an amorphous resin solution (Y3) was obtained. The obtained core resin had Mn of 2500 and a concentration of a urethane group of 1.78%. A concentration of a solid content in the amorphous resin solution (Y3) was 40 mass %.

Manufacturing Example 5

Manufacturing of Dispersion Liquid of Pigment (P1)

In a beaker, 20 parts by mass of acid-treated copper phthalocyanine ("FASTGEN Blue FDB-14" manufactured by DIC Corporation), 5 parts by mass of a dispersant for pigment "Ajisper PB-821" (manufactured by Ajinomoto Fine-Techno Co., Inc.), and 75 parts by mass of acetone were introduced and stirred to uniformly disperse acid-treated copper phthalocyanine. Thereafter, copper phthalocyanine was finely dispersed with the use of a bead mill. Thus, a dispersion liquid of a pigment (P1) was obtained. A volume average particle size of the pigment in the dispersion liquid of the pigment was 0.2 μm.

Manufacturing Example 6

Manufacturing of Liquid Developer (Z-1)

Thirty-two parts by mass of the solution (Y1) for forming the core resin and 8 parts by mass of the solution (Y2) for forming the core resin were introduced and mixed in a beaker, to thereby obtain a solution (Y4) for forming a core resin. The core resin contained in the solution (Y4) for forming the core resin had Mn of 26000.

Forty parts by mass of the solution (Y4) for forming the core resin and 20 parts by mass of the dispersion liquid of the pigment (P1) were introduced in a beaker and stirred at 8000 rpm with the use of TK Auto Homo Mixer (manufactured by PRIMIX Corporation) at 25° C. Thus, a resin solution (Y4P1) in which the pigment was uniformly dispersed was obtained.

In another beaker, 67 parts by mass of IP Solvent 2028 (manufactured by Idemitsu Kosan Co., Ltd.) and 9 parts by mass of the dispersion liquid (W1) of the shell particles were introduced to uniformly disperse the shell particles. Then, while TK Auto Homo Mixer was used at 25° C. to perform stirring at 10000 rpm, 60 parts by mass of the resin solution (Y4P1) was introduced and stirred for 2 minutes. Then, the obtained liquid mixture was introduced in a reaction vessel provided with a stirrer, a heating and cooling apparatus, a thermometer, and a desolventizer, and a temperature was raised to 35° C. At a reduced pressure of 0.039 MPa at that temperature, acetone was distilled out until a concentration of acetone was not higher than 0.5 mass %. Thus, a liquid developer (Z-1) was obtained.

Manufacturing Example 7

Manufacturing of Liquid Developer (Z-2)

Twenty-four parts by mass of the solution (Y1) for forming the core resin and 16 parts by mass of the solution (Y2) for forming the core resin were introduced and mixed in a beaker, to thereby obtain a solution (Y5) for forming a core resin. The core resin contained in the solution (Y5) for forming the core resin had Mn of 23000.

Forty parts by mass of the solution (Y5) for forming the core resin and 20 parts by mass of the dispersion liquid of the pigment (P1) were introduced in a beaker and stirred at 8000 rpm with the use of TK Auto Homo Mixer (manufactured by PRIMIX Corporation) at 25° C. Thus, a resin solution (Y5P1) in which the pigment was uniformly dispersed was obtained.

In another beaker, 67 parts by mass of IP Solvent 2028 (manufactured by Idemitsu Kosan Co., Ltd.) and 9 parts by mass of the dispersion liquid (W1) of the shell particles were introduced to uniformly disperse the shell particles. Then, while TK Auto Homo Mixer was used at 25° C. to perform stirring at 10000 rpm, 60 parts by mass of the resin solution (Y5P1) was introduced and stirred for 2 minutes. Then, the obtained liquid mixture was introduced in a reaction vessel provided with a stirring apparatus, a heating and cooling apparatus, a thermometer, and a desolventizer, and a temperature was raised to 35° C. At a reduced pressure of 0.039 MPa at that temperature, acetone was distilled out until a concentration of acetone was not higher than 0.5 mass %. Thus, a liquid developer (Z-2) was obtained.

Manufacturing Example 8

Manufacturing of Liquid Developer (Z-3)

Sixteen parts by mass of the solution (Y1) for forming the core resin and 24 parts by mass of the solution (Y2) for forming the core resin were introduced and mixed in a beaker, to thereby obtain a solution (Y6) for forming a core resin. The core resin contained in the solution (Y6) for forming the core resin had Mn of 19000.

Forty parts by mass of the solution (Y6) for forming the core resin and 20 parts by mass of the dispersion liquid of the pigment (P1) were introduced in a beaker and stirred at 8000 rpm with the use of TK Auto Homo Mixer (manufactured by PRIMIX Corporation) at 25° C. Thus, a resin solution (Y6P1) in which the pigment was uniformly dispersed was obtained.

In another beaker, 67 parts by mass of IP Solvent 2028 (manufactured by Idemitsu Kosan Co., Ltd.) and 9 parts by mass of the dispersion liquid (W1) of the shell particles were introduced to uniformly disperse the shell particles. Then, while TK Auto Homo Mixer was used at 25° C. to perform stirring at 10000 rpm, 60 parts by mass of the resin solution (Y6P1) was introduced and stirred for 2 minutes. Then, the obtained liquid mixture was introduced in a reaction vessel provided with a stirring apparatus, a heating and cooling apparatus, a thermometer, and a desolventizer, and a temperature was raised to 35° C. At a reduced pressure of 0.039 MPa at that temperature, acetone was distilled out until a concentration of acetone was not higher than 0.5 mass %. Thus, a liquid developer (Z-3) was obtained.

Manufacturing Example 9

Manufacturing of Liquid Developer (Z-4)

Forty parts by mass of the solution (Y1) for forming the core resin were introduced in a beaker, to thereby obtain a solution (Y7) for forming a core resin. The core resin contained in the solution (Y7) for forming the core resin had Mn of 30000.

Forty parts by mass of the solution (Y7) for forming the core resin and 20 parts by mass of the dispersion liquid of the pigment (P1) were introduced in a beaker and stirred at 8000 rpm with the use of TK Auto Homo Mixer (manufactured by PRIMIX Corporation) at 25° C. Thus, a resin solution (Y7P1) in which the pigment was uniformly dispersed was obtained.

In another beaker, 67 parts by mass of IP Solvent 2028 (manufactured by Idemitsu Kosan Co., Ltd.) and 9 parts by mass of the dispersion liquid (W1) of the shell particles were introduced to uniformly disperse the shell particles. Then, while TK Auto Homo Mixer was used at 25° C. to perform stirring at 10000 rpm, 60 parts by mass of the resin solution (Y7P1) was introduced and stirred for 2 minutes. Then, the obtained liquid mixture was introduced in a reaction vessel provided with a stirring apparatus, a heating and cooling apparatus, a thermometer, and a desolventizer, and a temperature was raised to 35° C. At a reduced pressure of 0.039 MPa at that temperature, acetone was distilled out until a concentration of acetone was not higher than 0.5 mass %. Thus, a liquid developer (Z-4) was obtained.

Manufacturing Example 10

Manufacturing of Liquid Developer (Z-5)

Eight parts by mass of the solution (Y1) for forming the core resin and 32 parts by mass of the solution (Y2) for forming the core resin were introduced and mixed in a beaker, to thereby obtain a solution (Y8) for forming a core resin. The core resin contained in the solution (Y8) for forming the core resin had Mn of 15600.

Forty parts by mass of the solution (Y8) for forming the core resin and 20 parts by mass of the dispersion liquid of the pigment (P1) were introduced in a beaker and stirred at 8000 rpm with the use of TK Auto Homo Mixer (manufactured by PRIMIX Corporation) at 25° C. Thus, a resin solution (Y8P1) in which the pigment was uniformly dispersed was obtained.

In another beaker, 67 parts by mass of IP Solvent 2028 (manufactured by Idemitsu Kosan Co., Ltd.) and 9 parts by mass of the dispersion liquid (W1) of the shell particles were introduced to uniformly disperse the shell particles. Then, while TK Auto Homo Mixer was used at 25° C. to perform stirring at 10000 rpm, 60 parts by mass of the resin solution (Y8P1) was introduced and stirred for 2 minutes. Then, the obtained liquid mixture was introduced in a reaction vessel provided with a stirring apparatus, a heating and cooling apparatus, a thermometer, and a desolventizer, and a temperature was raised to 35° C. At a reduced pressure of 0.039 MPa at that temperature, acetone was distilled out until a concentration of acetone was not higher than 0.5 mass %. Thus, a liquid developer (Z-5) was obtained.

Manufacturing Example 11

Manufacturing of Liquid Developer (Z-6)

Twenty-four parts by mass of the solution (Y4) for forming the core resin and 16 parts by mass of the amorphous resin solution (Y3) were introduced and mixed in a beaker, to thereby obtain a solution (Y9) for forming a core resin.

Forty parts by mass of the solution (Y9) for forming the core resin and 20 parts by mass of the dispersion liquid of the pigment (P1) were introduced in a beaker and stirred at 8000 rpm with the use of TK Auto Homo Mixer (manufactured by PRIMIX Corporation) at 25° C. Thus, a resin solution (Y9P1) in which the pigment was uniformly dispersed was obtained.

In another beaker, 67 parts by mass of IP Solvent 2028 (manufactured by Idemitsu Kosan Co., Ltd.) and 9 parts by mass of the dispersion liquid (W1) of the shell particles were introduced to uniformly disperse the shell particles. Then, while TK Auto Homo Mixer was used at 25° C. to perform stirring at 10000 rpm, 60 parts by mass of the resin solution (Y9P1) was introduced and stirred for 2 minutes. Then, the obtained liquid mixture was introduced in a reaction vessel provided with a stirring apparatus, a heating and cooling apparatus, a thermometer, and a desolventizer, and a temperature was raised to 35° C. At a reduced pressure of 0.039 MPa at that temperature, acetone was distilled out until a concentration of acetone was not higher than 0.5 mass %. Thus, a liquid developer (Z-6) was obtained.

Manufacturing Example 12

Manufacturing of Liquid Developer (Z-7)

Twenty-four parts by mass of the solution (Y6) for forming the core resin and 16 parts by mass of the amorphous resin solution (Y3) were introduced and mixed in a beaker, to thereby obtain a solution (Y10) for forming a core resin.

Forty parts by mass of the solution (Y10) for forming the core resin and 20 parts by mass of the dispersion liquid of the pigment (P1) were introduced in a beaker and stirred at 8000 rpm with the use of TK Auto Homo Mixer (manufactured by PRIMIX Corporation) at 25° C. Thus, a resin solution (Y10P1) in which the pigment was uniformly dispersed was obtained.

In another beaker, 67 parts by mass of IP Solvent 2028 (manufactured by Idemitsu Kosan Co., Ltd.) and 9 parts by mass of the dispersion liquid (W1) of the shell particles were introduced to uniformly disperse the shell particles. Then, while TK Auto Homo Mixer was used at 25° C. to perform stirring at 10000 rpm, 60 parts by mass of the resin solution (Y10P1) was introduced and stirred for 2 minutes. Then, the obtained liquid mixture was introduced in a reaction vessel provided with a stirring apparatus, a heating and cooling apparatus, a thermometer, and a desolventizer, and a temperature was raised to 35° C. At a reduced pressure of 0.039 MPa at that temperature, acetone was distilled out until a concentration of acetone was not higher than 0.5 mass %. Thus, a liquid developer (Z-7) was obtained.

Example 1

The transfer mechanism shown in FIG. 8 was used to transfer the liquid developer (Z-1) to a recording medium (OK top coat manufactured by Oji Paper Co., Ltd., 128 g/m$^2$). A velocity of transportation of the recording medium was set to 400 mm/s. The surface of photoconductor 29 was positively charged by charging portion 30. A potential of intermediate transfer element 33 was set to −400 V, and a potential of a secondary transfer roller 35 was set to −1200 V.

Thereafter, the fixer shown in FIG. 4 was used to fix toner particles contained in the liquid developer (Z-1) to the recording medium. A process speed was set to 400 mm/s. Pressure P during fixation was as shown in Tables 1 and 2. A heating temperature was adjusted such that temperature $T_1$ was set to 70° C. or 100° C.

Examples 2 to 12 and Comparative Examples 1 to 7

An image was formed in accordance with the method described in Example 1 above, except that the liquid developers shown in Tables 1 and 2 were used, fixation was carried out at pressures P shown in Tables 1 and 2, and a heating temperature was adjusted to temperatures $T_1$ shown in Tables 1 and 2.

<Measurement of Degree of Gloss>

Seventy-five-degree Gloss Meter ("VG-2000" manufactured by Nippon Denshoku Industries Co., Ltd.) was used to measure a degree of gloss of a solid portion of a fixed image. Tables 1 and 2 show results. In Tables 1 and 2, a degree of gloss not lower than 70 is denoted as A1, a degree of gloss not lower than 60 and lower than 70 is denoted as B1, a degree of gloss not lower than 50 and lower than 60 is denoted as C1, and a degree of gloss lower than 50 is denoted as D1. As a degree of gloss is higher, it can be concluded that such an image is excellent in glossiness.

<Measurement of Distortion of Image>

An edge portion of an image was magnified by 500 times and observed with a microscope ("vhx900" manufactured by Keyence Corporation), and whether or not the edge portion of the image was distorted due to fixation was checked. Tables 1 and 2 show results. In Tables 1 and 2, a case that no distortion was observed is denoted as A2, a case that slight distortion was observed is denoted as B2, and a case that significant distortion was observed is denoted as C2. Less distortion is concluded as being higher in image quality.

<Evaluation of High-Temperature Offset>

Whether or not high-temperature offset occurred was observed by feeding white paper immediately after feeding of a sample. Tables 1 and 2 show results. In Tables 1 and 2, a case that white paper was not contaminated with toner is denoted as A3, a case that white paper was slightly contaminated with toner is denoted as B3, and a case that white paper was significantly contaminated with toner is denoted as C3. When high-temperature offset occurs, first fixation roller 4 or second fixation roller 5 is contaminated and contamination is transferred to white paper. Therefore, unless white paper is contaminated with toner, it can be concluded that high-temperature offset has not occurred.

<Evaluation of Storage Stability>

Initially, an average particle size of toner particles contained in a liquid developer was measured with a laser diffraction particle size distribution analyzer ("SALD-2200" manufactured by Shimadzu Corporation). Then, the liquid developer was introduced up to approximately half of a sample bottle and the sample bottle was stored for 24 hours in a thermostatic bath set to 50° C. Thereafter, the laser diffraction particle size distribution analyzer was used to measure an average particle size of toner particles contained in the liquid developer. (An average particle size of the toner particles after storage)/(an average particle size of the toner particles before storage) was calculated. Tables 1 and 2 show results. In Tables 1 and 2, a case that the ratio above is not higher than 1.1 is denoted as A4 and a case that the ratio above is higher than 1.1 and not higher than 1.2 is denoted as B4. As this ratio is lower, deformation of toner particles during storage was suppressed, which can be concluded as excellent storage stability.

TABLE 1

| | Liquid Developer | $T_0$(Max) (° C.) | G'($T_0$(Max))/ G'($T_0$ + 10) | G'(70° C.)/ G'(100° C.) | G'(70° C.) (mPa · s) | Pressure P (kPa) | Temperature $T_1$ (° C.) | Degree of Gloss | Distortion of Image | High-Temperature Offset | Storage Stability |
|---|---|---|---|---|---|---|---|---|---|---|---|
| Example 1 | Z-1 | 50 | 89 | 4 | $3 \times 10^5$ | 230 | 70 | B1 | A2 | A3 | A4 |
| | | | | | | | 100 | B1 | A2 | A3 | A4 |
| Example 2 | | | | | $3 \times 10^5$ | 420 | 70 | A1 | A2 | A3 | A4 |
| | | | | | | | 100 | A1 | A2 | A3 | A4 |
| Example 3 | | | | | $3 \times 10^5$ | 580 | 70 | A1 | A2 | A3 | A4 |
| | | | | | | | 100 | A1 | A2 | A3 | A4 |
| Example 4 | | | | | $3 \times 10^5$ | 640 | 70 | A1 | B2 | A3 | A4 |
| | | | | | | | 100 | A1 | B2 | A3 | A4 |
| Example 5 | Z-2 | 52 | 96 | 6 | $3 \times 10^6$ | 230 | 70 | C1 | A2 | A3 | A4 |
| | | | | | | | 100 | C1 | A2 | A3 | A4 |
| Example 6 | | | | | $3 \times 10^6$ | 320 | 70 | B1 | A2 | A3 | A4 |
| | | | | | | | 100 | B1 | A2 | A3 | A4 |

TABLE 1-continued

| | Liquid Developer | $T_0$(Max) (° C.) | G'($T_0$(Max))/ G'($T_0$ + 10) | G'(70° C.)/ G'(100° C.) | G'(70° C.) (mPa · s) | Pressure P (kPa) | Temperature $T_1$ (° C.) | Degree of Gloss | Distortion of Image | High-Temperature Offset | Storage Stability |
|---|---|---|---|---|---|---|---|---|---|---|---|
| Example 7 | | | | | $3 \times 10^6$ | 420 | 70 | A1 | A2 | A3 | A4 |
| | | | | | | | 100 | A1 | A2 | A3 | A4 |
| Example 8 | | | | | $3 \times 10^6$ | 680 | 70 | A1 | A2 | A3 | A4 |
| | | | | | | | 100 | A1 | A2 | A3 | A4 |
| Example 9 | | | | | $3 \times 10^6$ | 730 | 70 | A1 | B2 | A3 | A4 |
| | | | | | | | 100 | A1 | B2 | A3 | A4 |
| Example 10 | Z-3 | 55 | 103 | 7 | $3 \times 10^7$ | 380 | 70 | C1 | A2 | A3 | A4 |
| | | | | | | | 100 | C1 | A2 | A3 | A4 |
| Example 11 | | | | | $3 \times 10^7$ | 430 | 70 | A1 | A2 | A3 | A4 |
| | | | | | | | 100 | A1 | A2 | A3 | A4 |
| Example 12 | | | | | $3 \times 10^7$ | 780 | 70 | A1 | A2 | A3 | A4 |
| | | | | | | | 100 | A1 | A2 | A3 | A4 |

$T_0$(Max) represents $T_0$ at the time when G'($T_0$)/G'($T_0$ + 10) takes a maximum value.

TABLE 2

| | Liquid Developer | $T_0$(Max) (° C.) | G'($T_0$(Max))/ G'($T_0$ + 10) | G'(70° C.)/ G'(100° C.) | G'(70° C.) (mPa · s) | Pressure P (kPa) | Temperature $T_1$ (° C.) | Degree of Gloss | Distortion of Image | High-Temperature Offset | Storage Stability |
|---|---|---|---|---|---|---|---|---|---|---|---|
| Comparative Example 1 | Z-1 | 50 | 89 | 4 | $3 \times 10^5$ | 180 | 70 | D1 | A2 | A3 | A4 |
| | | | | | | | 100 | D1 | A2 | A3 | A4 |
| Comparative Example 2 | Z-3 | 55 | 103 | 7 | $3 \times 10^7$ | 840 | 70 | B1 | C2 | A3 | A4 |
| | | | | | | | 100 | B1 | C2 | A3 | A4 |
| Comparative Example 3 | Z-4 | 47 | 86 | 4 | $3 \times 10^4$ | 300 | 70 | A1 | A2 | C3 | B4 |
| | | | | | | | 100 | A1 | A2 | C3 | B4 |
| Comparative Example 4 | Z-5 | 56 | 108 | 7 | $3 \times 10^8$ | 780 | 70 | D1 | A2 | B3 | A4 |
| | | | | | | | 100 | D1 | A2 | B3 | A4 |
| Comparative Example 5 | Z-2 | — | — | 19 | $3 \times 10^7$ | 780 | 70 | D1 | A2 | B3 | A4 |
| | | | | | | | 100 | B1 | A2 | B3 | A4 |
| Comparative Example 6 | Z-7 | — | — | 17 | $3 \times 10^5$ | 230 | 70 | B1 | A2 | A3 | B4 |
| | | | | | | | 100 | A1 | A2 | C3 | B4 |
| Comparative Example 7 | Z-7 | — | — | 17 | $3 \times 10^5$ | 780 | 70 | B1 | A2 | A3 | B4 |
| | | | | | | | 100 | A1 | A2 | C3 | B4 |

$T_0$(Max) represents $T_0$ at the time when G'($T_0$)/G'($T_0$ + 10) takes a maximum value.

Figure 9:
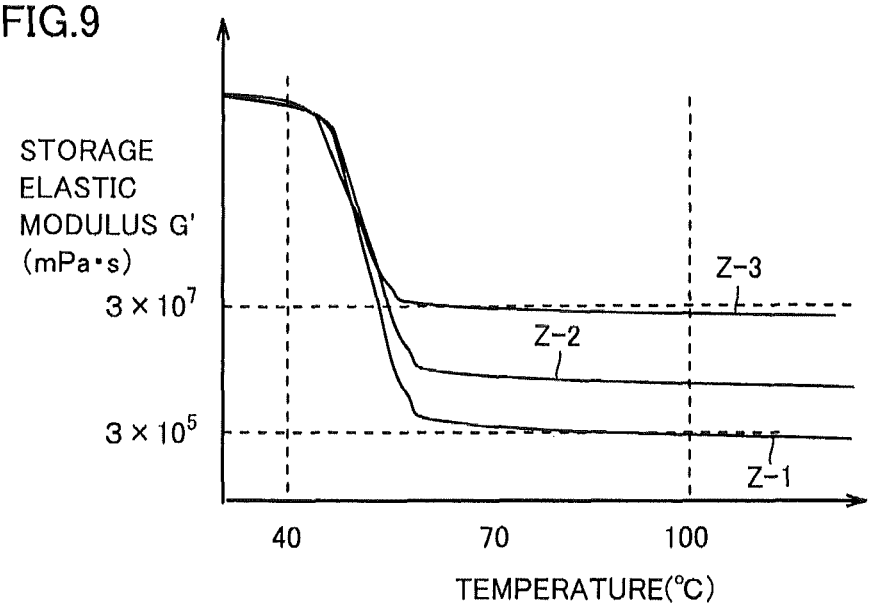
FIG. 9 is a graph showing results of measurement of temperature dependency of a storage elastic modulus of toner particles contained in each of liquid developers (Z-1) to (Z-3).
Figure 10:
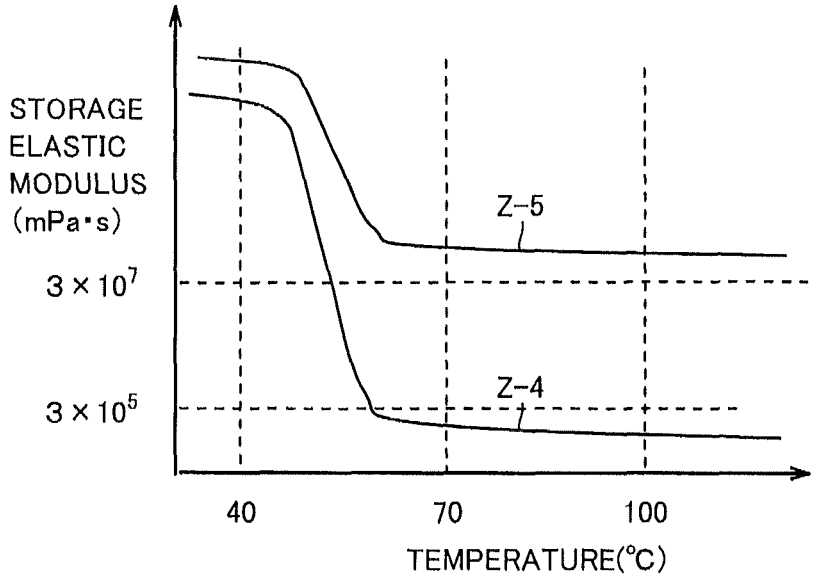
FIG. 10 is a graph showing results of measurement of temperature dependency of a storage elastic modulus of toner particles contained in each of liquid developers (Z-4) and (Z-5).
Figure 11:
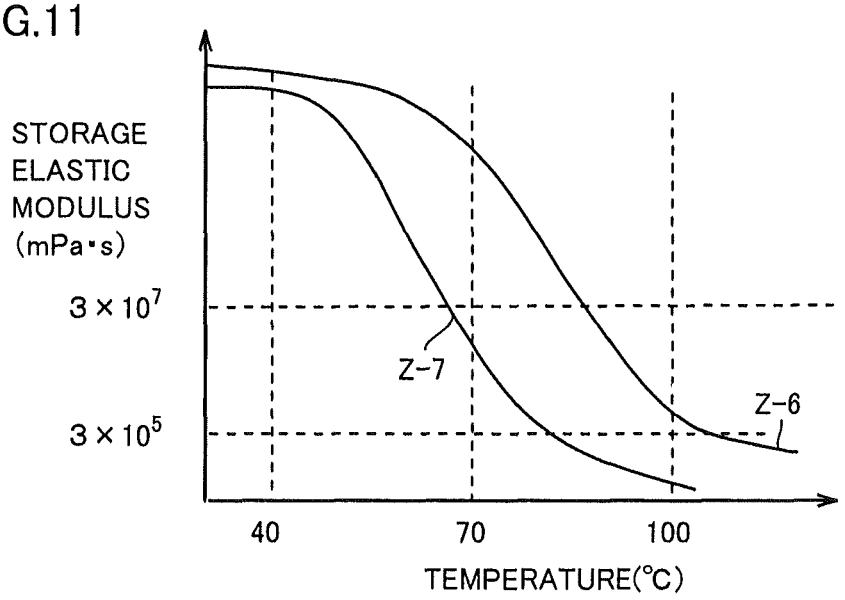
FIG. 11 is a graph showing results of measurement of temperature dependency of a storage elastic modulus of toner particles contained in each of liquid developers (Z-6) and (Z-7).
Figure 12:
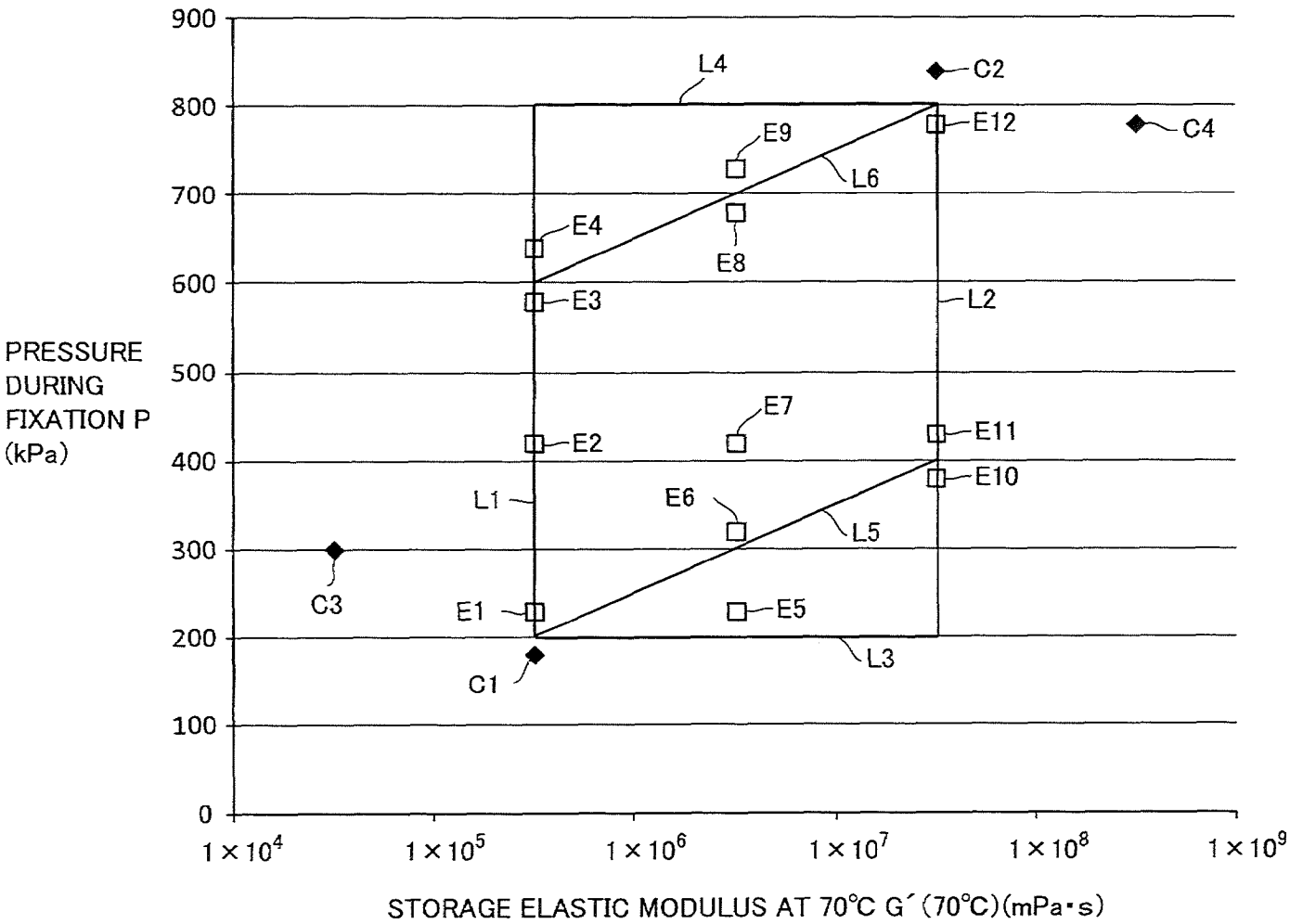
FIG. 12 is a graph showing results in Examples.

FIGS. 9 to 11 show results of measurement of temperature dependency of a storage elastic modulus of toner particles contained in each of the liquid developers (Z-1) to (Z-7). FIG. 12 shows relation between pressure P (kPa) and storage elastic modulus of toner particles at 70° C. G'(70° C.). In FIG. 12, L1 represents a straight line satisfying storage elastic modulus of toner particles at 70° C. G'(70° C.)=$3\times10^5$ mPa·s, and L2 represents a straight line satisfying G'(70° C.)=$3\times10^7$ mPa·s. L3 represents a straight line satisfying a pressure P during fixation=200 kPa, and L4 represents a straight line satisfying P=800 kPa. L5 represents a straight line satisfying P=43.429 ln {G'(70° C.)}−347.8, and L6 represents a straight line satisfying P=43.429 ln {G'(70° C.)}+52.3.

In Examples 1 to 12, fixation from 70° C. to 100° C. was possible and an image excellent in glossiness without producing distortion in image was obtained. In addition, a liquid developer achieving prevention of occurrence of high-temperature offset and having excellent storage stability was obtained.

In Example 3 and Example 4, the same results for a degree of gloss, occurrence of high-temperature offset, and storage stability were exhibited, however, occurrence of image distortion was suppressed more in Example 3 than in Example 4. The reason may be because the Expression (4) was satisfied in Example 3, whereas the Expression (4) was not satisfied in Example 4. In other words, it is possible that Example 4 is present above L6 in FIG. 12. The above is applicable also to Example 8 and Example 9.

In Example 5 and Example 6, the same results for occurrence of image distortion, occurrence of high-temperature offset, and storage stability were exhibited, however, an image higher in glossiness was obtained in Example 6 than in Example 5. The reason may be because the Expression (4) was satisfied in Example 6, whereas the Expression (4) was not satisfied in Example 5. In other words, it is possible that Example 5 is present below L5 in FIG. 12. The above is applicable also to Example 10 and Example 11.

In Comparative Example 1, glossiness of an image lowered. The reason may be because pressure P (kPa) during fixation was lower than 200 kPa. In other words, it is possible that Comparative Example 1 is present below L3 in FIG. 12.

In Comparative Example 2, image distortion occurred. The reason may be because pressure P (kPa) during fixation was higher than 800 kPa. In other words, it is possible that Comparative Example 2 is present above L4 in FIG. 12.

In Comparative Example 3, high-temperature offset occurred. The reason may be because storage elastic modulus of toner particles at 70° C. G'(70° C.) was lower than $3\times10^5$ mPa·s (see FIG. 10). In other words, it is possible that Comparative Example 3 is present on the left of L1 in FIG. 12.

In Comparative Example 4, glossiness of an image lowered. The reason may be because storage elastic modulus of toner particles at 70° C. G'(70° C.) was higher than $3\times10^7$ mPa·s (see FIG. 10). In other words, it is possible that Comparative Example 4 is present on the right of L2 in FIG. 12.

In Comparative Example 5, glossiness of an image lowered when temperature $T_1$ was set to 70° C. The reason may be because G'(70° C.)/G'(100° C.) was higher than 10 (G'(70° C.)/G'(100° C.)>10) (see FIG. 11). In Comparative Examples 6 and 7, high-temperature offset occurred when temperature $T_1$ was set to 100° C. The reason may also be because G'(70° C.)/G'(100° C.) was higher than 10 (G'(70° C.)/G'(100° C.)>10) (see FIG. 11).

[Examples of Dry Developer]

<Preparation of Dispersion Liquid a of Crystalline Polyester Resin Particles>

At a ratio of 51 mol % of 1,6-hexanediol, 49 mol % of pimelic acid, and 0.08 mol % of dibutyltin oxide (a catalyst), they were mixed in a flask. In an atmosphere at a reduced pressure, heating to 220° C. was carried out and dehydration-condensation reaction was caused for 6.5 hours. A crystalline polyester resin was thus obtained.

Eighty parts by mass of the obtained crystalline polyester resin and 720 parts by mass of deionized water were placed in a beaker made of stainless steel, and the beaker was heated to 55° C. by being immersed in a hot bath. At a time point of melt of the crystalline polyester resin, stirring at 7000 rpm with the use of a homogenizer (a trade name "T50 Ultra-Turrax" manufactured by IKA) was carried out. Emulsion dispersion was carried out while 1.8 part by mass of an anionic surfactant (20 mass % of a trade name "Neogen RK" manufactured by DKS Co., Ltd.) was dropped into the solution. Thus, a dispersion liquid A of the crystalline polyester resin particles (a solid content of 10 mass %) having a volume average particle size of 0.160 μm was obtained. The obtained crystalline polyester resin had a melting point of 52° C.

<Preparation of Dispersion Liquid B of Amorphous Polyester Resin Particles>

At a ratio of 23 mol % of dimethyl terephthalate, 10 mol % of isophthalic acid, 15 mol % of dodecenyl succinic anhydride, 3 mol % of trimellitic anhydride, 5 mol % of an adduct of ethylene oxide to bisphenol A, and 45 mol % of an adduct of propylene oxide to bisphenol A, they were introduced in a reaction vessel to which a stirrer, a thermometer, a condenser, and a nitrogen gas introduction pipe were attached. Replacement with a dry nitrogen gas in the reaction vessel was carried out. Thereafter, dibutyltin oxide (a catalyst) was added at a ratio of 0.06 mol % and reaction was caused while stirring, under a nitrogen gas current at approximately 190° C. for approximately 7 hours. The temperature was raised to approximately 250° C., and while stirring, reaction was caused for approximately 5.0 hours. A pressure in the reaction vessel was reduced to 10.0 mmHg, and while stirring, reaction was caused at a reduced pressure for approximately 0.5 hour. A dispersion liquid B of the amorphous polyester resin particles was thus obtained. The obtained amorphous polyester resin had a glass transition point (Tg) of 60° C. and a mass average molecular weight (Mw) of 24000.

<Preparation of Dispersion Liquid C of Coloring Agent>

One hundred parts by mass of a cyan pigment (Pigment Blue 15:3 (copper phthalocyanine) manufactured by DIC Corporation), 15 parts by mass of an anionic surfactant (a trade name "Neogen R" manufactured by DKS Co., Ltd.), and 900 parts by mass of ion exchanged water were mixed. The obtained solution mixture was dispersed for approximately 1 hour with the use of a high-pressure impact disperser ultimizer (a trade name "HJP30O06" manufactured by Sugino Machine Limited). A dispersion liquid C of the coloring agent in which the cyan pigment was dispersed was thus obtained. The obtained dispersion liquid C of the coloring agent had an average particle size of the cyan pigment of 0.15 μm and a concentration of the cyan pigment of 25 mass %.

<Preparation of Dispersion Liquid D of Release Agent>

Fifty parts by mass of ester wax WEP-5 (manufactured by Nippon Oil & Fats Co., Ltd.), 5 parts by mass of an anionic surfactant (a trade name "Neogen RK" manufactured by DKS Co., Ltd.), and 200 parts by mass of ion exchanged water were mixed and heated to 110° C. The obtained solution mixture was dispersed with the use of a homogenizer (a trade name "T50 Ultra-Turrax" manufactured by IKA), and thereafter dispersion treatment was carried out with the use of Manton-Gaulin high-pressure homogenizer (manufactured by Gaulin). A dispersion liquid D of the release agent in which the release agent having an average particles size of 0.21 μm was dispersed (a concentration of the release agent was 26 mass %) was thus obtained.

Example 13

Preparation of Toner Particles

In a polymerization kettle to which a pH meter, a stirring blade, and a thermometer were attached, 80 parts by mass of the dispersion liquid A of the crystalline polyester resin particles, 20 parts by mass of the dispersion liquid B of the amorphous polyester resin particles, 7 parts by mass of an anionic surfactant (a 20% aqueous solution of Dowfax 2A1), and 100 parts by mass of ion exchanged water were placed and stirred at 140 rpm for 15 minutes. To this solution, 10 parts by mass of the dispersion liquid C of the coloring agent and 10 parts by mass of the dispersion liquid D of the release agent were added.

To the obtained source material mixture, 0.3 M of a nitric acid aqueous solution was added and pH of the solution was adjusted to 4.8. While shear force was applied with Ultra-Turrax at 4000 rpm, 0.5 part by mass of a 10% nitric acid aqueous solution of polyaluminum chloride (an aggregation agent manufactured by Asada Chemical INDUSTRY Co., Ltd.) was dropped into the solution of which pH was adjusted to 4.8. Since viscosity of the solution increased during dropping of the aggregation agent, a rate of dropping of the aggregation agent was lowered such that the aggregation agent was dropped as not being concentrated at one location. When dropping of the aggregation agent ended, the number of rotations was raised to 5000 rpm and the solution was stirred for 5 minutes. The aggregation agent and the source material mixture were thus mixed and slurry of the source material mixture was obtained.

While the number of rotations of the stirrer was adjusted as appropriate so as to sufficiently stir the slurry of the source material mixture, a temperature of the solution was increased to 40° C. at 1.0° C./min. and held at 40° C. for 30 minutes. While a temperature of the solution was increased at 0.1° C./min., a volume average particle size of the slurry was measured every 10 minutes with the use of Multisizer II (an aperture diameter: 50 μm, manufactured by Beckman Coulter). When the volume average particle size of the slurry attained to 5.0 μm, 10 parts by mass of the dispersion liquid B of the amorphous polyester resin particles (a shell layer) were added to the solution for 3 minutes. After the solution was held for 30 minutes, 5 mass % of a sodium hydroxide aqueous solution was added so as to set pH of the solution to 8.0.

While pH of the solution was adjusted to 8.0 each time a temperature was increased by 5.0° C., a temperature of the solution was increased to 85° C. at a temperature increase rate of 1° C./min. and the solution was held at 85° C. A shape and a surface of the particles were observed every 30 minutes with the use of an optical microscope and a scanning electron microscope (FE-SEM). Since the particles were confirmed to be spherical at the time when 1.5 hour had elapsed, a temperature of the solution was lowered to 20° C. at 10° C./min. so as to solidify the particles. Thereafter, a reaction product was filtrated and sufficiently cleaned with ion exchanged water, and thereafter dried with a flush drier. Toner base particles were thus obtained.

To 100 parts by mass of toner base particles, 1 part by mass of silica particles (a trade name "H1303" manufactured by Clariant Japan K. K., which is inorganic particles for external addition) and 1 part by mass of particles having an average particles size of 110 nm (particles obtained by subjecting surfaces of silica particles obtained with a sol gel method to hydrophobization treatment with hexamethyldisilazane (HMDS)) were added. The resultant product was placed in a 5 L Henschel mixer (a trade name "FM5C") manufactured by Mitsui Mining Co., Ltd. so as to carry out external addition and mixing. Toner particles having a volume average particles size of 5.9 μm were thus obtained.

(Preparation of Carrier)

In a high-speed mixer with a stirring blade, 100 parts by mass of a ferrite core and 5 parts by mass of copolymer resin particles of cyclohexyl methacrylate/methyl methacrylate (at a copolymerization ratio of 5/5) were placed, and stirred and mixed at 120° C. for 30 minutes. Thus, a resin layer was formed on a surface of the ferrite core owing to a function of mechanical impact force, and the carrier having a median diameter of 40 μm was obtained.

A median diameter of the carrier was measured with a laser diffraction particle size distribution analyzer (a trade name "HELOS", manufactured by Sympatec GmbH) provided with a wet disperser.

(Preparation of Dry Developer)

The toner particles were added to the carrier such that a concentration of the toner particles was 7 mass %. This solution was placed into Micro V-shape Mixer (manufactured by Tsutsui Scientific Instruments Co., Ltd.) and mixed for 30 minutes at a rotation speed of 45 rpm. A dry developer D1 in the present Example was thus obtained.

(Image Formation)

A fixation apparatus (a trade name "bishub PRO C6500") manufactured by Konica Minolta, Inc. was modified, and a fixation temperature was changed to 70° C. and 100° C. and a pressure during fixation was changed to 4 levels of 230 kPa, 420 kPa, 580 kPa, and 640 kPa. An image of a filled-in patch was produced with the use of the modified fixation apparatus. OK top coat 128 g/m$^2$ manufactured by Oji Paper Co., Ltd. was employed as the recording medium.

Example 14 and Comparative Example 8

In Example 14, a dry developer D2 was obtained in accordance with the method described in Example 13 above, except that a part by mass of the dispersion liquid A of the crystalline polyester resin particles was changed to 60 parts by mass and a part by mass of the dispersion liquid B of the amorphous polyester resin particles was changed to 40 parts by mass. An image of a filled-in patch was produced with the use of the dry developer D2 in accordance with the method described in Example 13.

In Comparative Example 8, a dry developer D3 was obtained in accordance with the method described in Example 13 above, except that a part by mass of the dispersion liquid A of the crystalline polyester resin particles was changed to 40 parts by mass, a part by mass of the dispersion liquid B of the amorphous polyester resin particles was changed to 60 parts by mass, a part by mass of the dispersion liquid of the coloring agent was changed to 7 parts by mass, a part by mass of the anionic surfactant was changed to 4 parts by mass, and a part by mass of the dispersion liquid of the release agent was changed to 7 parts by mass. An image of a filled-in patch was produced with the use of the dry developer D3 in accordance with the method described in Example 13.

<Measurement of Degree of Gloss, Measurement of Image Distortion, and Evaluation of High-Temperature Offset>

A degree of gloss and image distortion were measured and high-temperature offset was evaluated in accordance with the method described in [Examples of Liquid Developer]. Table 3 shows results.

In Examples 13 and 14, fixation from 70° C. to 100° C. was possible, an image excellent in glossiness was obtained without occurrence of image distortion, and occurrence of high-temperature offset was prevented. An image higher in glossiness was obtained in a case that pressure P (kPa) during fixation was not lower than 400 kPa than in a case that pressure P (kPa) during fixation was lower than 400 kPa.

On the other hand, in Comparative Example 8, glossiness of an image lowered when temperature $T_1$ was set to 70° C. In addition, the image was distorted and high-temperature offset occurred. The reason may be because G'(70° C.)/G'(100° C.) was higher than 10 (G'(70° C.)/G'(100° C.)>10).

<Evaluation of Heat-Resistant Storability>

Five grams of toner particles were placed and hermetically sealed in a 100-cc glass tube, and the glass tube was stored at 50° C. for 24 hours. Thereafter, the toner particles were sieved through a 90-μm mesh sieve. Table 3 shows results. As shown in Table 3, in Examples 13 and 14 and Comparative Example 8, no remainder from sieving was observed and it was found that they were excellent in heat-resistant storability.

TABLE 3

| | Dry Developer | $T_0$(Max) (° C.) | G'($T_0$(Max))/G'($T_0$ + 10) | G'(70° C.)/G'(100° C.) | G'(70° C.) (mPa · s) | Pressure P (kPa) | Temperature $T_1$ (° C.) | Degree of Gloss | Distortion of Image | High-Temperature Offset | Heat-Resistant Storability |
|---|---|---|---|---|---|---|---|---|---|---|---|
| Example 13 | D1 | 54 | 76 | 7 | 7 × 10$^6$ | 230 | 70 | B1 | A2 | A3 | A4 |
| | | | | | | | 100 | B1 | A2 | A3 | A4 |
| | | | | | | 420 | 70 | A1 | A2 | A3 | A4 |
| | | | | | | | 100 | A1 | A2 | A3 | A4 |
| | | | | | | 580 | 70 | A1 | A2 | A3 | A4 |
| | | | | | | | 100 | A1 | A2 | A3 | A4 |
| | | | | | | 640 | 70 | A1 | A2 | A3 | A4 |
| | | | | | | | 100 | A1 | A2 | A3 | A4 |

TABLE 3-continued

| | Dry Developer | $T_0$(Max) (° C.) | G'($T_0$(Max))/G'($T_0$ + 10) | G'(70° C.)/G'(100° C.) | G'(70° C.) (mPa · s) | Pressure P (kPa) | Temperature $T_1$ (° C.) | Degree of Gloss | Distortion of Image | High-Temperature Offset | Heat-Resistant Storability |
|---|---|---|---|---|---|---|---|---|---|---|---|
| Example 14 | D2 | 56 | 67 | 9 | $1 \times 10^7$ | 230 | 70 | B1 | B2 | B3 | A4 |
| | | | | | | | 100 | B1 | B2 | A3 | A4 |
| | | | | | | 420 | 70 | B1 | A2 | A3 | A4 |
| | | | | | | | 100 | A1 | A2 | A3 | A4 |
| | | | | | | 580 | 70 | A1 | A2 | A3 | A4 |
| | | | | | | | 100 | A1 | A2 | A3 | A4 |
| | | | | | | 640 | 70 | A1 | A2 | A3 | A4 |
| | | | | | | | 100 | A1 | A2 | A3 | A4 |
| Comparative Example 8 | D3 | 59 | 41 | 13 | $6 \times 10^8$ | 230 | 70 | C1 | C2 | C3 | A4 |
| | | | | | | | 100 | C1 | C2 | B3 | A4 |
| | | | | | | 420 | 70 | C1 | C2 | C3 | A4 |
| | | | | | | | 100 | B1 | C2 | B3 | A4 |
| | | | | | | 580 | 70 | B1 | C2 | C3 | A4 |
| | | | | | | | 100 | A1 | C2 | C3 | A4 |
| | | | | | | 640 | 70 | A1 | C2 | C3 | A4 |
| | | | | | | | 100 | A1 | C2 | C3 | A4 |

$T_0$(Max) represents $T_0$ at the time when G'($T_0$)/G'($T_0$ + 10) takes a maximum value.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image formation method, comprising the steps of:

preparing an electrostatic latent image developer having toner particles containing a coloring agent and a resin and satisfying A to C below;

transferring said electrostatic latent image developer to a recording medium; and fixing said toner particles contained in the electrostatic latent image developer transferred to said recording medium to said recording medium, $$A: G'(T_0)/G'(T_0+10) \geq 10 \quad \text{Expression(1)}$$

$$40 \leq T0 \leq 60 \quad \text{Expression (2)}$$

being satisfied, where G'($T_0$) represents a storage elastic modulus (mPa) of said toner particles at $T_0$ (° C.) and G'($T_0$+10) represents a storage elastic modulus (mPa) of said toner particles at ($T_0$+10) (° C.), B: a storage elastic modulus of said toner particles at 70° C. G'(70° C.) being not lower than $3\times10^5$ mPa and not higher than $3\times10^7$ mPa, and C: a storage elastic modulus of said toner particles not having a relative minimum value and a relative maximum value at a temperature not lower than 70° C. and not higher than 100° C. and $$G'(70°\ C.)/G'(100°\ C.) \leq 10 \quad \text{Expression(3)}$$

being satisfied, where G'(70° C.) represents a storage elastic modulus of said toner particles at 70° C. and G'(100° C.) represents a storage elastic modulus of said toner particles at 100° C., and said step of fixing said toner particles to said recording medium including the steps of heating said recording medium, and fixing said toner particles to said recording medium at a pressure P not lower than 200 kPa and not higher than 800 kPa.

2. The image formation method according to claim 1, wherein said pressure P (kPa) satisfies $$43.429 \ln \{G'(70°\ C.)\} - 347.8 \leq P \leq 43.429 \ln \{G'(70°\ C.)\} + 52.3 \quad \text{Expression (4).}$$

3. The image formation method according to claim 1, wherein said pressure P is not lower than 400 kPa.

4. The image formation method according to claim 1, wherein a temperature of said recording medium after the step of fixing said toner particles to said recording medium is not lower than 70° C. and not higher than 100° C.

5. The image formation method according to claim 1, wherein said electrostatic latent image developer is a liquid developer containing said toner particles and an insulating liquid for dispersing said toner particles.

6. The image formation method according to claim 5, wherein said toner particles satisfy D: said resin containing 80 mass % or more of a first resin which is a urethane-modified polyester resin resulting from increase in chain length of a component derived from a polyester resin by a compound containing an isocyanate group, E: said component derived from the polyester resin containing a constitutional unit derived from an acid component and a constitutional unit derived from an alcohol component, F: a ratio of a constitutional unit derived from an aliphatic monomer occupied in said constitutional unit derived from the acid component and said constitutional unit derived from the alcohol component being not lower than 80 mass %, and G: said first resin having a concentration of a urethane group not lower than 0.5% and not higher than 5%.

7. The image formation method according to claim 5, wherein said toner particles have a core/shell structure having a core resin formed from said first resin and a shell resin containing a vinyl resin in which a hydrocarbon long chain is provided in a molecule.

8. An image formation apparatus, comprising:

an electrostatic latent image developer having toner particles containing a coloring agent and a resin and satisfying A to C below;

a transfer portion transferring said electrostatic latent image developer to a recording medium;

a fixation portion fixing said toner particles contained in the electrostatic latent image developer transferred to said recording medium to said recording medium; and a heating portion heating said recording medium, $$A: G'(T_0)/G'(T_0+10) \geq 10 \quad \text{Expression(1)}$$

$$40 \leq T_0 \leq 60 \quad \text{Expression (2)}$$

being satisfied, where $G'(T_0)$ represents a storage elastic modulus (mPa) of said toner particles at $T_0$ (° C.) and $G'(T_0+10)$ represents a storage elastic modulus (mPa) of said toner particles at $(T_0+10)$ (° C.), B: a storage elastic modulus of said toner particles at 70° C. G'(70° C.) being not lower than $3\times10^5$ mPa and not higher than $3\times10^7$ mPa, and C: a storage elastic modulus of said toner particles not having a relative minimum value and a relative maximum value at a temperature not lower than 70° C. and not higher than 100° C. and $$G'(70°\ C.)/G'(100°\ C.) \leq 10 \quad \text{Expression (3)}$$

being satisfied, where G'(70° C.) represents a storage elastic modulus of said toner particles at 70° C. and G'(100° C.) represents a storage elastic modulus of said toner particles at 100° C., and said fixation portion fixing said toner particles to said recording medium at a pressure P not lower than 200 kPa and not higher than 800 kPa.

9. The image formation apparatus according to claim 8, wherein said fixation portion fixes said toner particles to said recording medium at said pressure P (kPa) satisfying $$43.429 \ln \{G'(70°\ C.)\} - 347.8 \leq P \leq 43.429 \ln \{G'(70°\ C.)\} + 52.3 \quad \text{Expression (4).}$$

10. The image formation apparatus according to claim 8, wherein said fixation portion fixes said toner particles to said recording medium at a pressure P not lower than 400 kPa.

11. The image formation apparatus according to claim 8, wherein said heating portion heats said recording medium such that a temperature of said recording medium after passage through said fixation portion is not lower than 70° C. and not higher than 100° C.

12. The image formation apparatus according to claim 8, wherein said electrostatic latent image developer is a liquid developer containing said toner particles and an insulating liquid for dispersing said toner particles.

13. The image formation apparatus according to claim 12, wherein said toner particles satisfy D: said resin containing 80 mass % or more of a first resin which is a urethane-modified polyester resin resulting from increase in chain length of a component derived from a polyester resin by a compound containing an isocyanate group, E: said component derived from the polyester resin containing a constitutional unit derived from an acid component and a constitutional unit derived from an alcohol component, F: a ratio of a constitutional unit derived from an aliphatic monomer occupied in said constitutional unit derived from the acid component and said constitutional unit derived from the alcohol component being not lower than 80 mass %, and G: said first resin having a concentration of a urethane group not lower than 0.5% and not higher than 5%.

14. The image formation apparatus according to claim 12, wherein said toner particles have a core/shell structure having a core resin formed from said first resin and a shell resin containing a vinyl resin in which a hydrocarbon long chain is provided in a molecule.

* * * * *